US011732710B2

(12) United States Patent
Fukuda et al.

(10) Patent No.: US 11,732,710 B2
(45) Date of Patent: Aug. 22, 2023

(54) SCREW COMPRESSOR, AND REFRIGERATION DEVICE

(71) Applicant: DAIKIN INDUSTRIES, LTD., Osaka (JP)

(72) Inventors: Daigo Fukuda, Osaka (JP); Hiromichi Ueno, Osaka (JP); Takashi Inoue, Osaka (JP); Nozomi Gotou, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/951,127

(22) Filed: Sep. 23, 2022

(65) Prior Publication Data

US 2023/0015175 A1 Jan. 19, 2023

Related U.S. Application Data

(63) Continuation of application No. PCT/JP2021/013380, filed on Mar. 29, 2021.

(30) Foreign Application Priority Data

Mar. 31, 2020 (JP) ..... JP2020-063218

(51) Int. Cl.
*F04C 2/16* (2006.01)
*F25B 31/02* (2006.01)

(52) U.S. Cl.
CPC ..... *F04C 2/16* (2013.01); *F25B 31/026* (2013.01); *F04C 2240/30* (2013.01); *F25B 2400/13* (2013.01)

(58) Field of Classification Search
CPC .. F04C 2/16; F04C 2240/30; F04C 2240/809; F04C 18/082; F04C 29/02;
(Continued)

(56) References Cited

U.S. PATENT DOCUMENTS

2010/0260639 A1 10/2010 Hossain et al.

FOREIGN PATENT DOCUMENTS

CN 203023055 U 6/2013
JP 2000257578 A * 9/2000
(Continued)

OTHER PUBLICATIONS

International Search Report of corresponding PCT Application No. PCT/JP2021/013380 dated Jun. 1, 2021.
(Continued)

*Primary Examiner* — Ana M Vazquez
(74) *Attorney, Agent, or Firm* — Global IP Counselors, LLP

(57) ABSTRACT

A screw compressor includes a screw rotor having a plurality of screw grooves, a plurality of gate rotors each including gates that mesh with the screw rotor, and a casing. The screw rotor is rotatably inserted in the casing. The casing has a cylindrical wall through which the gates pass. The screw compressor has a plurality of compression chambers inside the cylindrical wall. The plurality of compression chambers are defined by the screw rotor and the gates. The compression chambers include a first compression chamber and a second compression chamber. A fluid introduced into the casing at a suction pressure is compressed to an intermediate pressure higher than the suction pressure in the first compression chamber. The fluid at the intermediate pressure is compressed to a discharge pressure higher than the intermediate pressure in the second compression chamber.

24 Claims, 20 Drawing Sheets

(58) Field of Classification Search
CPC .... F04C 2240/20; F04C 18/52; F25B 31/026;
F25B 2400/13; F25B 1/047
See application file for complete search history.

(56) References Cited

FOREIGN PATENT DOCUMENTS

| | | | |
|---|---|---|---|
| JP | 4120733 | B2 | 7/2008 |
| WO | 2009/081788 | A1 | 7/2009 |
| WO | 2016/189648 | A1 | 12/2016 |
| WO | WO-2020026333 | A1 * | 2/2020 |

OTHER PUBLICATIONS

International Preliminary Report of corresponding PCT Application No. PCT/JP2021/013380 dated Oct. 13, 2022.

* cited by examiner

SCREW COMPRESSOR, AND REFRIGERATION DEVICE

CROSS-REFERENCE TO RELATED APPLICATIONS

This is a continuation of International Application No. PCT/JP2021/013380 filed on Mar. 29, 2021, which claims priority to Japanese Patent Application No. 2020-063218, filed on Mar. 31, 2020. The entire disclosures of these applications are incorporated by reference herein.

BACKGROUND

Technical Field

The present disclosure relates to a screw compressor and a refrigeration apparatus.

Background Art

A screw compressor has been used as a compressor for compressing a working fluid. For example, Japanese Patent No. 4120733 discloses a screw compressor that includes screw rotors each having a plurality of screw grooves and gate rotors each having radial teeth (gates) meshing with associated ones of the screw grooves.

The screw compressor of Japanese Patent No. 4120733 is configured to compress a working fluid in two stages. Specifically, this screw compressor includes a low-stage compression mechanism including a low-stage screw rotor and low-stage gate rotors, and a high-stage compression mechanism including a high-stage screw rotor and high-stage gate rotors. The low-stage screw rotor and the high-stage screw rotor are coaxially arranged.

SUMMARY

A first aspect of the present disclosure is directed to a screw compressor including a screw rotor having a plurality of screw grooves, a plurality of gate rotors each including gates that mesh with the screw rotor, and a casing with the screw rotor rotatably inserted therein. The casing has a cylindrical wall through which the gates pass. The screw compressor is configured to have a plurality of compression chambers inside the cylindrical wall. The plurality of compression chambers are defined by the screw rotor and the gates. The compression chambers include a first compression chamber in which a fluid introduced into the casing at a suction pressure is compressed to an intermediate pressure higher than the suction pressure, and a second compression chamber in which the fluid at the intermediate pressure is compressed to a discharge pressure higher than the intermediate pressure.

DETAILED DESCRIPTION OF EMBODIMENT(S)

First Embodiment

A screw compressor according to a first embodiment will be described. This screw compressor is provided in a refrigerant circuit (not shown), and is configured to compress a refrigerant serving as a working fluid in two stages.

Figure 1:
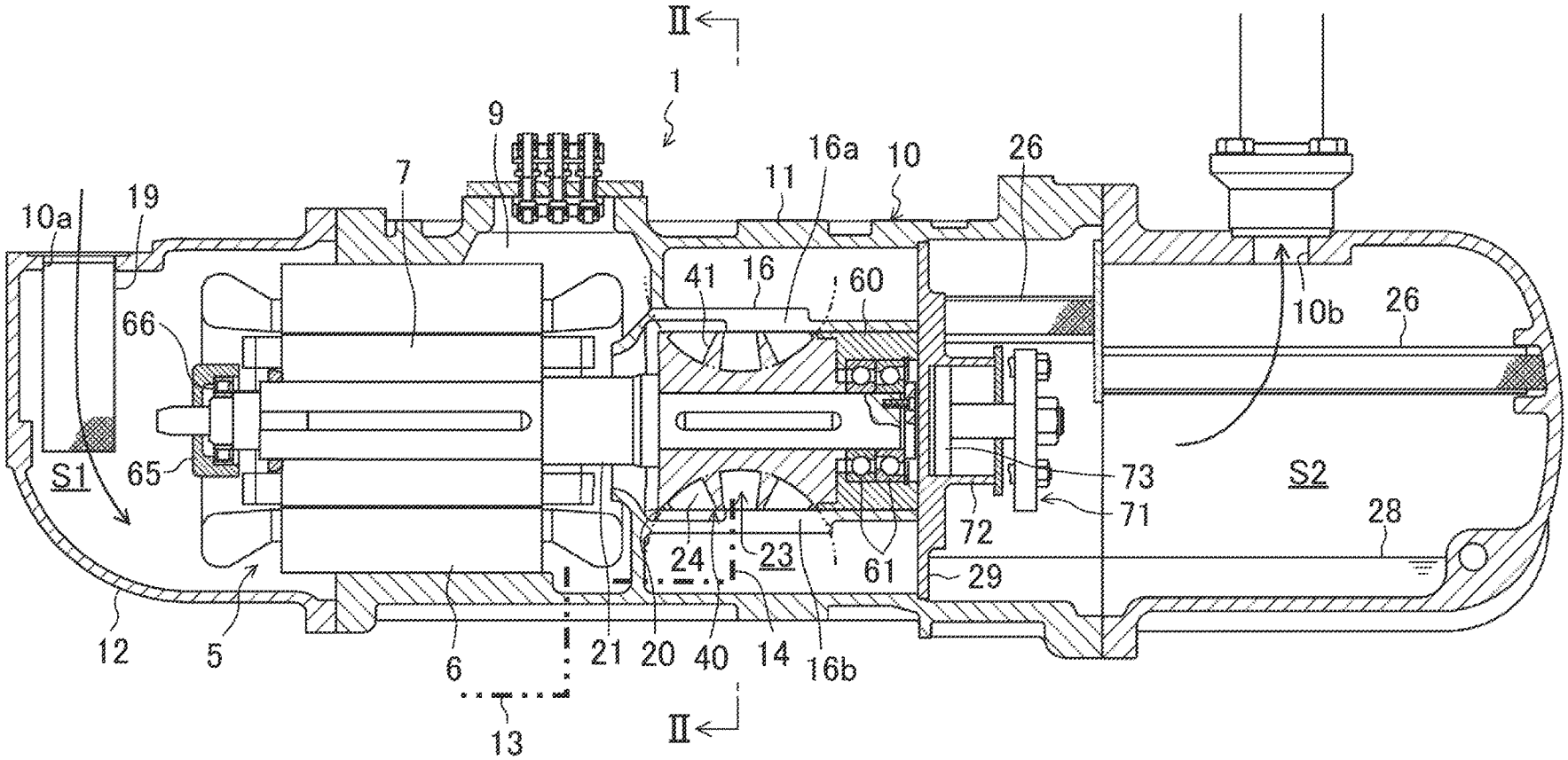
FIG. 1 is a cross-sectional view illustrating an overall structure of a screw compressor according to an embodiment.
Figure 2:
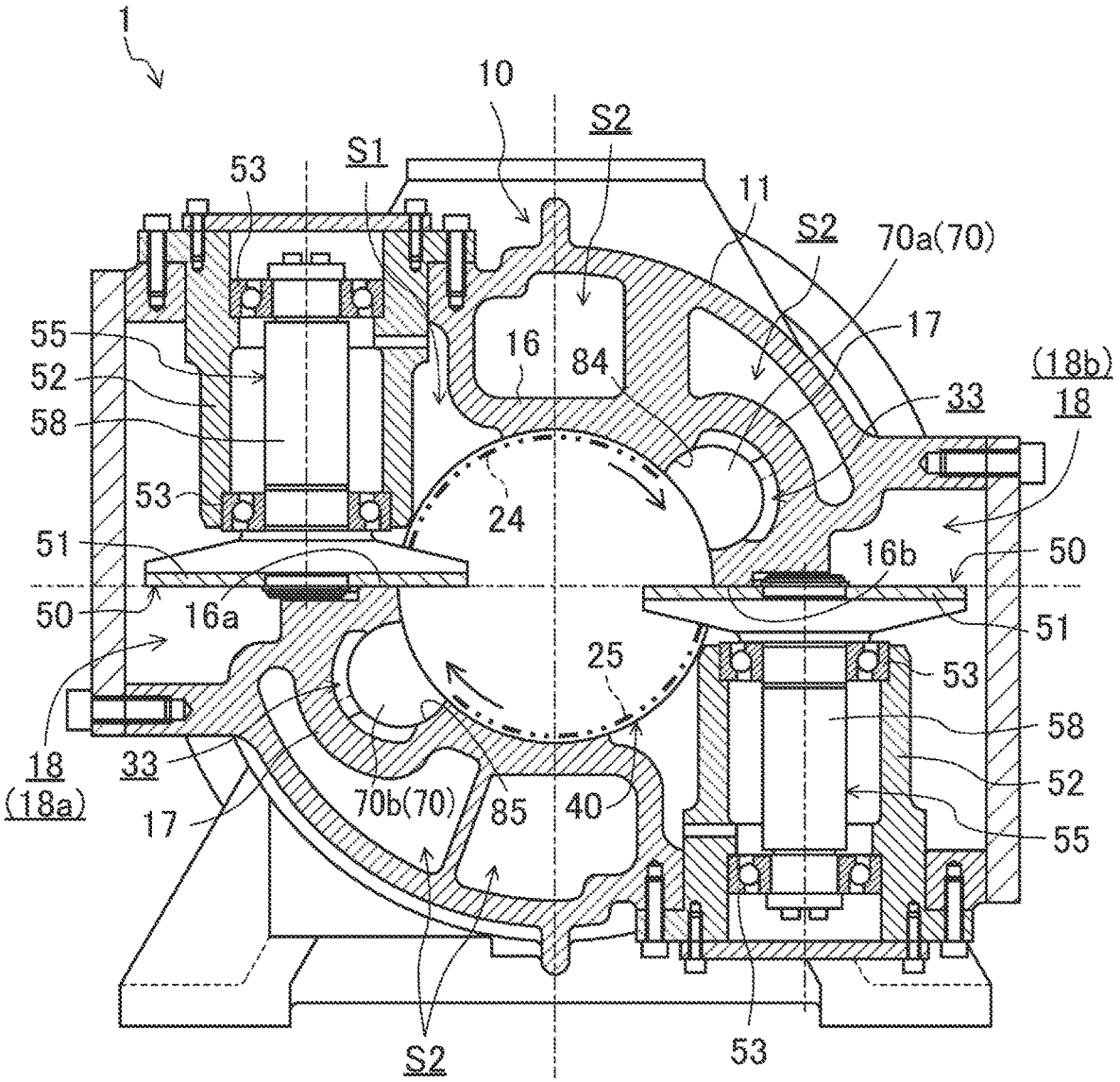
FIG. 2 is an enlarged cross-sectional view taken along line 11-11 of FIG. 1.
Figure 3:
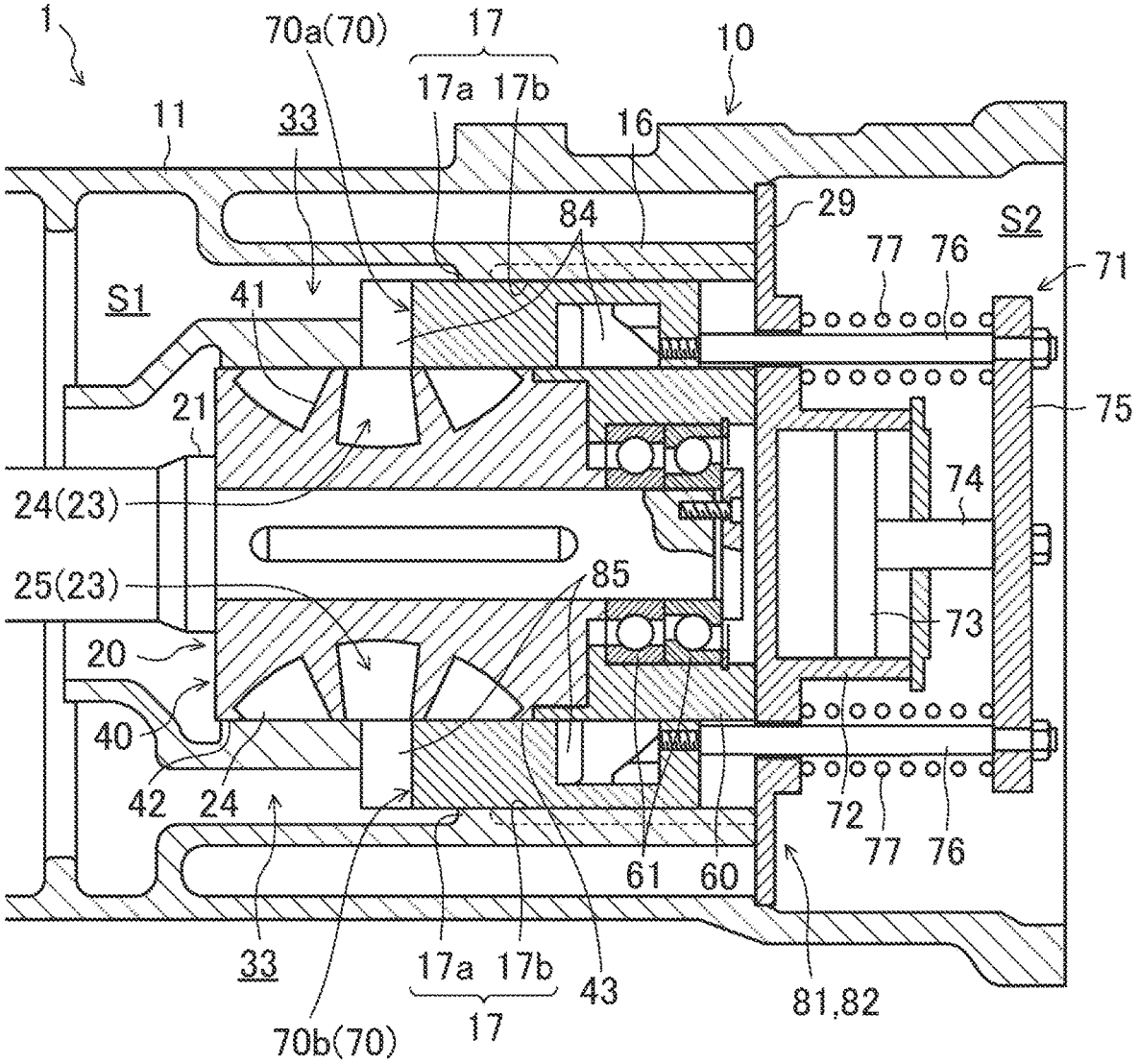
FIG. 3 is an enlarged view of an essential part of FIG. 1.

FIG. 1 is a cross-sectional view showing an overall structure of a screw compressor (1). FIG. 2 is an enlarged cross-sectional view taken along line II-II of FIG. 1. FIG. 3 is an enlarged view of an essential part of FIG. 1. In FIGS. 1 and 2, in this screw compressor (1), a compression mechanism (20) and a motor (5) for driving the compression mechanism (20) are housed in a metal casing (10). The compression mechanism (20) is coupled to the motor (5) via a drive shaft (21).

Casing

The casing (10) includes a main easing (11) into which a screw rotor (40) to be described later is fitted, and an end casing (12) fixed to the main casing (11). The casing (10) includes therein a low-pressure space (S1) into which a low-pressure gas refrigerant flows and a high-pressure space (S2) into which a high-pressure gas refrigerant that has been discharged from the compression mechanism (20) flows.

Low-Pressure Space of Casing

An inlet (10*a*) is formed in a portion of the casing (10), the portion being adjacent to the low-pressure space (S1). A suction-side filter (19) is attached to the inlet (10*a*), and collects relatively large foreign matter contained in the gas refrigerant to be sucked into the casing (10).

Motor

The motor (5) includes a stator (6) and a rotor (7). The stator (6) is fixed to the inner peripheral surface of the casing (10) in the low-pressure space (S1). The rotor (7) is coupled to one end of the drive shaft (21), which rotates together with the rotor (7).

Compression Mechanism

The compression mechanism (20) includes a cylindrical wall (16) formed in the casing (10), one screw rotor (40), and two gate rotors (50). The cylindrical wall is formed in the casing (10). The screw rotor (40) is fitted into the cylindrical wall (16). The two gate rotors (50) pass through the cylindrical wall (16), and mesh with the screw rotor (40).

The screw rotor (40) is a metal member having a generally columnar shape. The outer diameter of the screw rotor (40) is set to be slightly smaller than the inner diameter of the cylindrical wall (16). The outer peripheral surface of the screw rotor (40) is close to the inner peripheral surface of the cylindrical wall (16). An outer periphery of the screw rotor (40) has a plurality of screw grooves (41) extending helically. The screw grooves (41) extend from one axial end toward the other axial end of the screw rotor (40). The drive shaft (21) is coupled to the screw rotor (40). The drive shaft (21) and the screw rotor (40) rotate together.

One end of the drive shaft (21) is coupled to the screw rotor (40). The screw rotor (40) is rotatably supported by a first bearing holder (60) via a first bearing (61). The first bearing holder (60) is held by the cylindrical wall (16) of the casing (10). The other end of the drive shaft (21) is rotatably supported on a second bearing (66) serving as a rolling bearing. The second bearing (66) is held by a second bearing holder (65).

Figure 4:
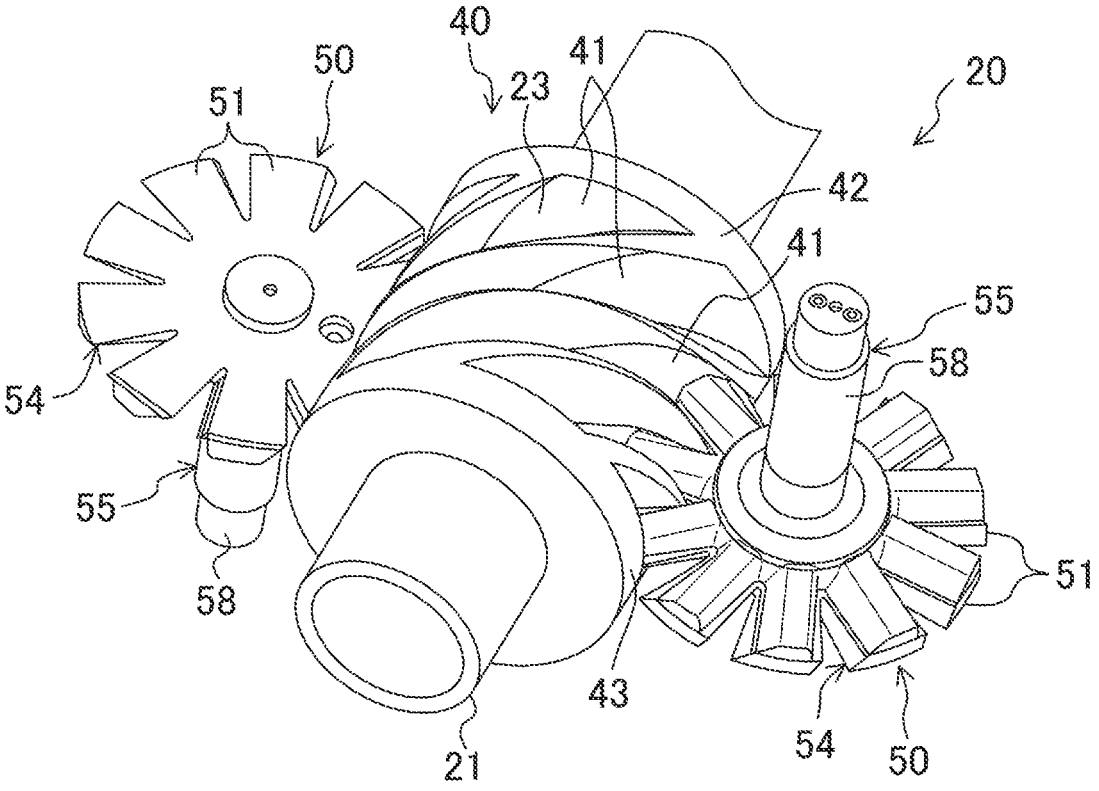
FIG. 4 is a first perspective view showing how a screw rotor and gate rotor assemblies mesh with each other.
Figure 5:
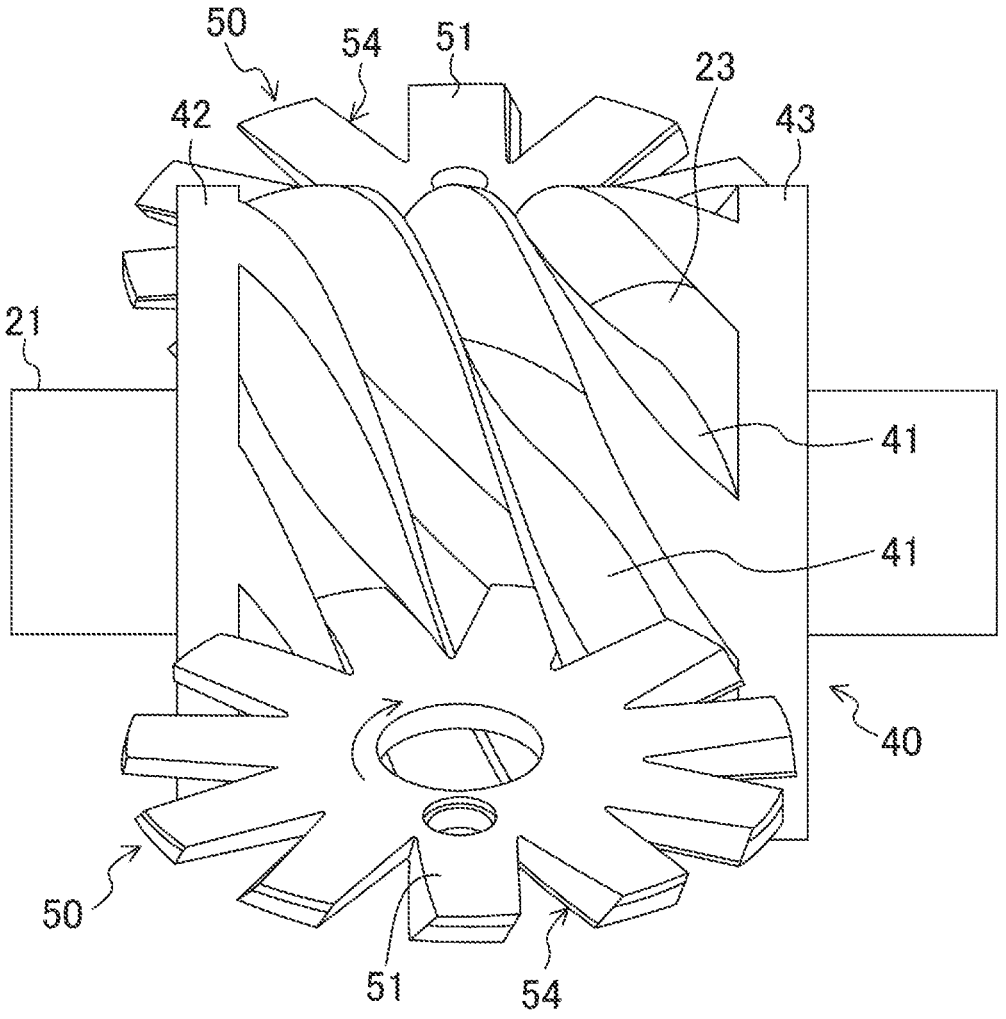
FIG. 5 is a second perspective view showing how the screw rotor and the gate rotor assemblies mesh with each other.

FIGS. 4 and 5 are perspective views showing how the screw rotor (40) and the gate rotors (50) mesh with each other. The gate rotors (50) each include gates (51), which are a plurality of teeth arranged radially. The gate rotors (50) each include a gate body (54) meshing with the screw grooves (41), and a gate support (55) supporting the gate body (54) from the low-pressure side. The gate rotors (50) are housed in associated gate rotor chambers (18) illustrated in FIG. 2. The gate rotor chambers (18) are sectioned in the casing (10) and adjacent to the cylindrical wall (16).

In this compression mechanism (20), the inner peripheral surface of the cylindrical wall (16), the screw grooves (41) of the screw rotor (40), and the two gate rotors (50) surround compression chamber (23). The screw grooves (41) of the screw rotor (40) are formed between a first end portion (42) and a second end portion (43) of the screw rotor (40) at both axial ends of the screw rotor (40). In FIG. 2, a shaft (58) of each gate support (55) is rotatably supported by a bearing housing (52) in the associated gate rotor chamber (18) via ball bearings (53).

In this embodiment, the groove number of the screw grooves (41) is six, and the number of the teeth forming the gates (51) is ten. The number of the screw grooves (41) and the number of the teeth forming the gates (51) may be changed. In this case, the ratio N1/N2 of the number N1 to the number N2 is preferably set to be greater than or equal to 3/5, where N1 represents the number of the screw grooves (41), and N2 represents the number of the teeth forming the gates (51).

High-Pressure Space of Casing

As shown in FIG. 1, an oil reservoir (28) is provided on the bottom of the casing (10) in the high-pressure space (S2). Oil stored in the oil reservoir (28) is used for lubricating drive components such as the screw rotor (40). The space in which the compression mechanism (20) is disposed is separated from the oil reservoir (28) by a fixing plate (29).

An outlet (10*b*) is formed in an upper portion of the casing (10), the upper portion being adjacent to the high-pressure space (S2). An oil separator (26) is disposed above the oil reservoir (28). The oil separator (26) separates oil from the high-pressure refrigerant. Specifically, when the high-pressure refrigerant that has been compressed in the compression chamber (23) passes through the oil separator (26), the oil contained in the high-pressure refrigerant is captured by the oil separator (26). The oil that has been captured by the oil separator (26) is collected in the oil reservoir (28). On the other hand, the high-pressure refrigerant from which the oil has been separated is discharged out of the casing (10) through the outlet (10*b*).

Slide Valve and Driving Mechanism

As shown in FIG. 3, the screw compressor (1) is provided with slide valves (70). Each slide valve (70) is housed in a corresponding one of valve storing portions (17) that are two circumferential portions, of the cylindrical wall (16), protruding radially outwardly (see FIG. 2). The slide valves (70) are slidable along the axis of the cylindrical wall (16), and face the outer peripheral surface of the screw rotor (40) when inserted in the valve storing portions (17).

The screw compressor (1) is provided with a driving mechanism (71) configured to drive and slide the slide valves (70). The driving mechanism (71) includes: a cylinder (72) formed on a right sidewall surface of the fixing plate (29); a piston (73) fitted in the cylinder (72); an arm (75) coupled to a piston rod (74) of the piston (73); connecting rods (76) connecting the arm (75) to the slide valves (70); and springs (77) biasing the arm (75) rightward in FIG. 3.

The driving mechanism (71) adjusts the positions of the slide valves (70) by controlling the movement of the piston (73) through regulation of the gas pressure applied to right and left end faces of the piston (73).

The slide valves (70) are capable of adjusting the position of the screw rotor (40) in the axial direction. The slide valves (70) can be used as an unloading mechanism configured to return the refrigerant that is being compressed in the compression chamber (23) toward the suction side to change the operating capacity. The slide valves (70) can also be used as a compression ratio regulation mechanism configured to adjust the timing when the refrigerant is discharged from the compression chamber (23) to regulate the compression ratio (internal volume ratio).

As shown in FIG. 3, the outer peripheral wall of the valve storing portion (17) includes: a partition wall (17*a*) separating the low-pressure space (S1) from the high-pressure space (S2); and a guide wall (17*b*) extending axially from the central position in the width direction of the partition wall (17*a*) toward the high-pressure space (S2).

The cylindrical wall (16) is provided with a fixed discharge port (not shown) always communicating with the compression chamber (23) regardless of the positions of the slide valves (70). The fixed discharge port is provided so as to keep the compression chamber (23) from being hermetically closed in order to substantially avoid liquid compression at the timing when the screw compressor (1) is actuated or is at a low load.

Details of Compression Mechanism and Slide Valve

The compression chamber (23) includes a first compression chamber (24) that is a low-stage side in the two-stage compression and a second compression chamber (25) that is a high-stage side in the two-stage compression. In other words, the compression chamber (23) includes a plurality of compression chambers (24, 25) formed inside the cylindrical wall (16) and defined by the screw rotor (40) and the gate rotors (50). The first compression chamber (24) compresses the refrigerant introduced into the casing (10) at a suction pressure to an intermediate pressure higher than the suction pressure. The second compression chamber (25) compresses the refrigerant at the intermediate pressure to a discharge pressure (a high pressure) higher than the intermediate pressure.

The gate rotor chambers (18) include a first gate rotor chamber (18*a*) and a second gate rotor chamber (18*b*). The first gate rotor chamber (18*a*) is configured to supply the refrigerant to the first compression chamber (24). The second gate rotor chamber (18*b*) is configured to supply the refrigerant that has flowed out of the first compression chamber (24) to the second compression chamber (25).

The casing (10) has a first space communicating with the first compression chamber (24) and a second space communicating with the second compression chamber (25), around the cylindrical wall (16). In this embodiment, the first space is the low-pressure space (S1), and communicates with the first compression chamber (24) via the first gate rotor chamber (18*a*). The second gate rotor chamber (18*b*) is an intermediate-pressure space, and the second space is the high-pressure space (S2). The low-pressure space (S1) serving as the first space, the first gate rotor chamber (18*a*), the first compression chamber (24), the second gate rotor chamber (18*b*) serving as the intermediate-pressure space, the second compression chamber (25), and the high-pressure space (S2) serving as the second space are connected together in an ascending order of the pressures of the fluid.

Each of both axial end portions of the screw rotor (40) has a sealing portion formed between the cylindrical wall (16) and the screw rotor (40) to reduce the circulation of the fluid. Specifically, the first end portion (42) of the screw rotor (40) constitutes a first sealing portion, and the second end portion (43) constitutes a second sealing portion. Each of the first end portion (42) and the second end portion (43) has a smooth cylindrical outer peripheral surface without any screw grooves (41). Each of the first end portion (42) and the second end portion (43) is provided with, for example, a labyrinth seal or a mechanical seal.

The cylindrical wall (16) has slits (16*a*, 16*b*) through which the gates (51) pass. These slits (16*a*, 16*b*) include a first slit (16*a*) through which the low-pressure space (S1) and the first gate rotor chamber (18*a*) communicate with the first compression chamber (24), and a second slit (16*b*) through which the second gate rotor chamber (18*b*) serving as the intermediate-pressure space communicates with the second compression chamber (25). The first slit (16*a*) constitutes a first inlet through which the low-pressure refrigerant in the low-pressure space (S1) is introduced into the first compression chamber (24). The second slit (16*b*) constitutes a second inlet through which the refrigerant in the intermediate-pressure space is introduced into the second compression chamber (25).

The casing (10) has a motor chamber (9) in which the motor (5) configured to drive the screw rotor (40) is housed. The casing (10) is provided with an introduction passage (13) through which the refrigerant at the intermediate pressure is introduced into the motor chamber (9), and a communication passage (14) communicating with the second compression chamber (25) from the motor chamber (9) via the second gate rotor chamber (18*b*).

Operation

Strokes of Suction, Compression, and Discharge

First, a suction stroke, a compression stroke, and a discharge stroke included in operation of the screw compressor (1) will be described. When the motor (5) is driven, the drive shaft (21) and the screw rotor (40) rotate. When the screw rotor (40) rotates, the gate rotors (50) meshing with the screw grooves (41) rotate. Thus, in the compression mechanism (20), the suction stroke, the compression stroke, and the discharge stroke are successively repeated. These strokes will be described with reference to FIGS. 6 to 8.

Figure 6:
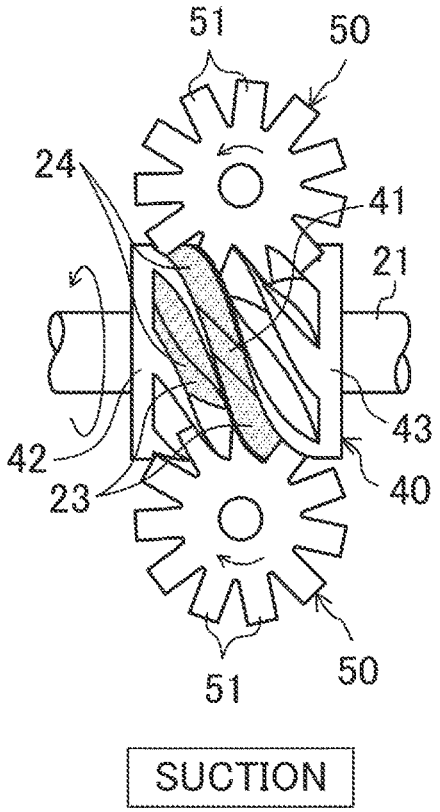
FIG. 6 is a plan view schematically showing a suction stroke of the screw compressor.

In the suction stroke shown in FIG. 6, the compression chamber (23) hatched (strictly speaking, the suction chamber) communicates with the space adjacent to the suction side. The screw groove (41) corresponding to this compression chamber (23) meshes with the gate (51) of the gate rotor (50). When the screw rotor (40) rotates, the gate (51) relatively moves toward the terminal end of the screw groove (41), and the volume of the compression chamber (23) increases accordingly. As a result, the refrigerant is sucked into the compression chamber (23).

Figure 7:
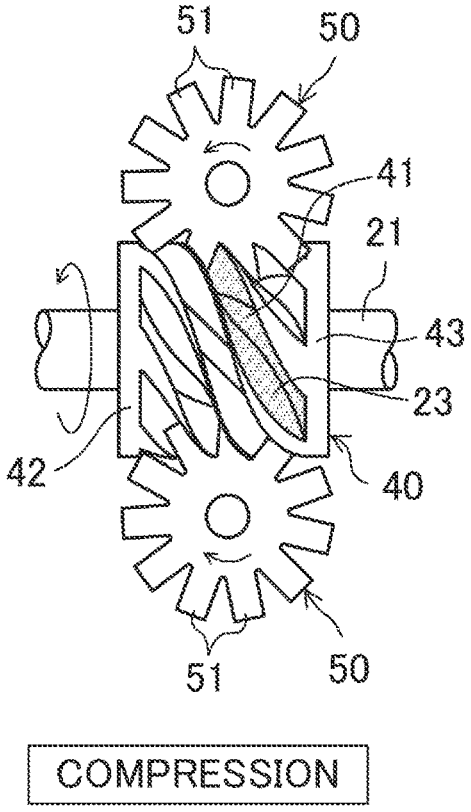
FIG. 7 is a plan view schematically showing a compression stroke of the screw compressor.

When the screw rotor (40) further rotates, the compression stroke shown in FIG. 7 is performed. In the compression stroke, the hatched compression chamber (23) is completely closed. That is to say, the screw groove (41) corresponding to the compression chamber (23) is separated, by the gate (51), from the space adjacent to the suction side. When the gate (51) approaches the terminal end of the screw groove (41) in accordance with the rotation of the screw rotor (40), the volume of the compression chamber (23) gradually decreases. As a result, the refrigerant in the compression chamber (23) is compressed.

Figure 8:
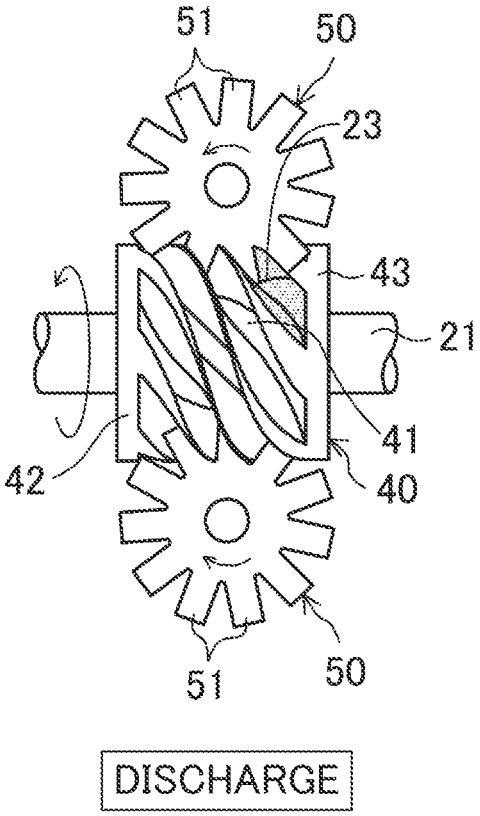
FIG. 8 is a plan view schematically showing a discharge stroke of the screw compressor.

When the screw rotor (40) further rotates, the discharge stroke shown in FIG. 8 is performed. In the discharge stroke, the compression chamber (23) hatched (strictly speaking, the discharge chamber) communicates with the fixed discharge port via the end adjacent to the discharge side (the right end in the figure). When the gate (51) approaches the terminal end of the screw groove (41) in accordance with the rotation of the screw rotor (40), the refrigerant that has been compressed is pushed out from the compression chamber (23) through the fixed discharge port to the space adjacent to the discharge side.

Two-Stage Compression

Figure 9:
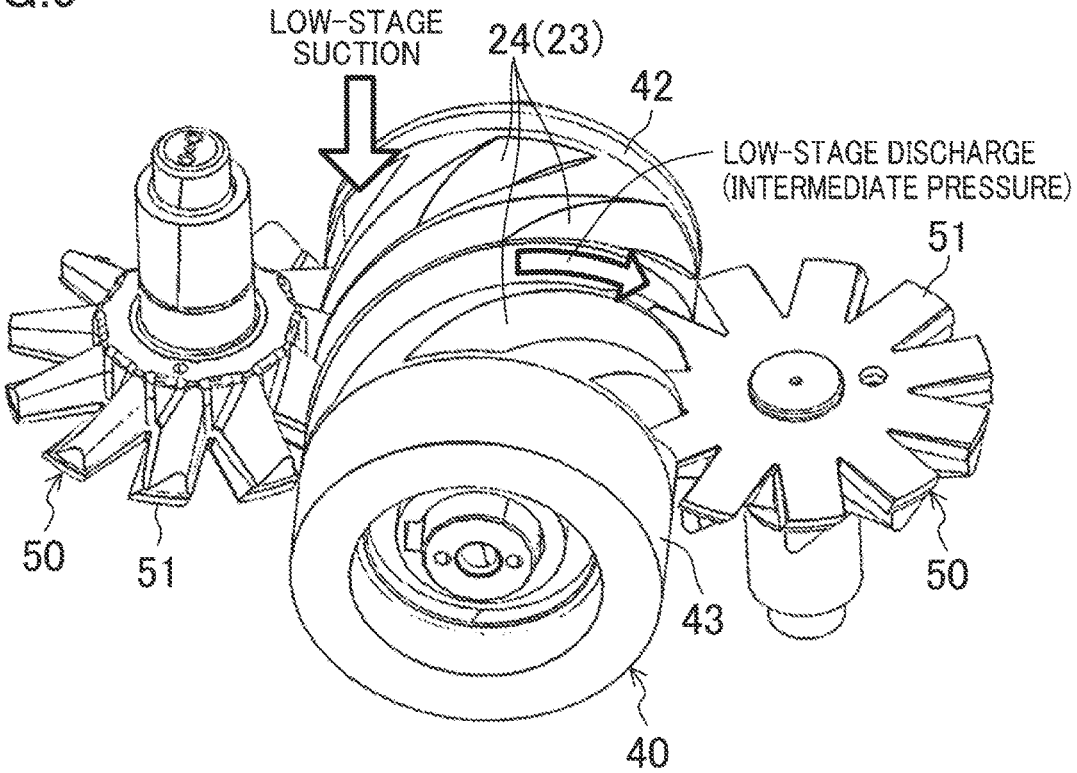
FIG. 9 is a perspective view illustrating a flow of a refrigerant during low-stage compression.
Figure 10:
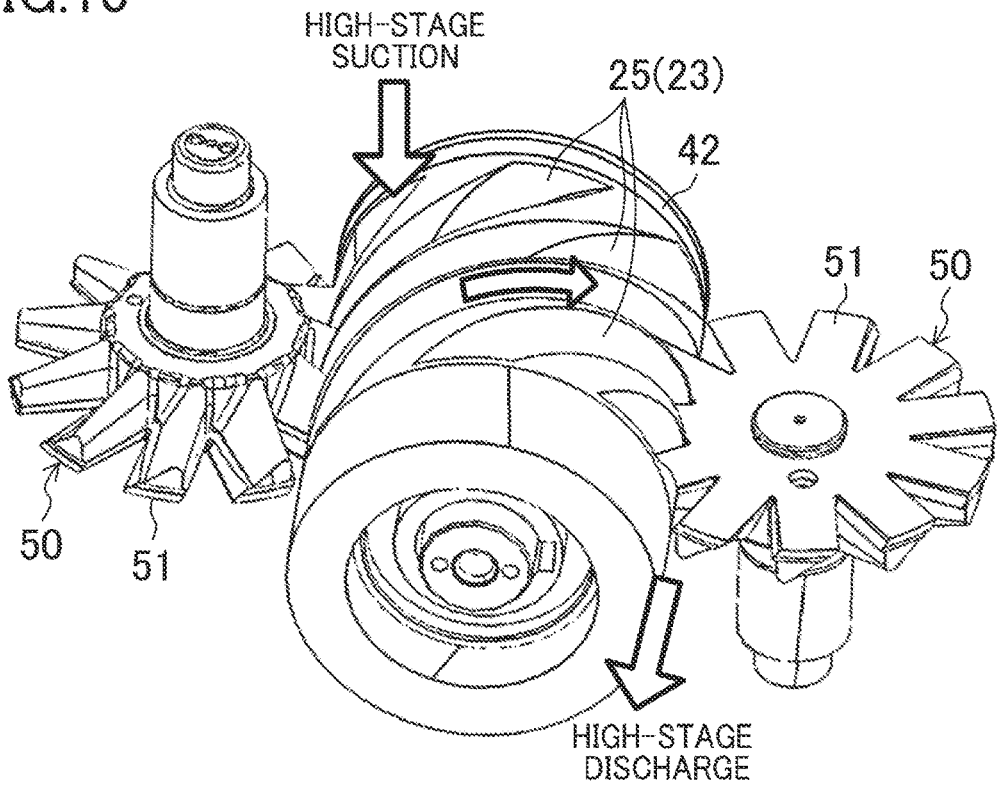
FIG. 10 is a perspective view illustrating a flow of a refrigerant during high-stage compression.

Next, operation for two-stage compression will be described with reference to FIGS. 9 and 10. The refrigerant sucked into the casing (10) flows into the low-pressure space (S1) serving as the first space, and is then introduced from the low-pressure space (S1) into the first gate rotor chamber (18*a*). The low-pressure refrigerant in the first gate rotor chamber (18*a*) is sucked through the first slit (16*a*) into the first compression chamber (24). The intermediate-pressure refrigerant compressed in the first compression chamber (24) flows out of the first compression chamber (24), and flows into the second gate rotor chamber (18*b*) serving as the intermediate-pressure space.

The intermediate-pressure refrigerant in the second gate rotor chamber (18*b*) is sucked through the second slit (16*b*) into the second compression chamber (25). The high-pressure refrigerant compressed in the second compression chamber (25) flows out of the second compression chamber (25), and flows into the high-pressure space (S2) serving as the second space. Oil is separated from the refrigerant that has flowed into the high-pressure space (S2) by the oil separator (26). The resultant refrigerant flows out of the casing (10) through the outlet (10*b*).

Advantages of First Embodiment

In the first embodiment, the compression chamber (23) of the screw compressor including the one screw rotor (40) and the plurality of gate rotors (50) include the first and second compression chambers (24) and (25). In the first compression chamber (24), the refrigerant introduced into the casing (10) at the suction pressure is compressed to the intermediate pressure higher than the suction pressure. In the second compression chamber (25), the refrigerant at the intermediate pressure is compressed to the discharge pressure higher than the intermediate pressure.

In this embodiment, the fluid compressed in the first compression chamber (24) is further compressed in the second compression chamber (25). Thus, the refrigerant is compressed in two stages.

Since a low-stage screw rotor and a high-stage screw rotor of a known screw compressor (Patent Document 1) that enables two-stage compression are coaxially arranged, the total length of the screw rotors is long, resulting in an increase in the size of the compressor. In contrast, according to this embodiment, a configuration including the one screw rotor (40) and the plurality of gate rotors (50) enables two-stage compression. This reduces an increase in the size of the compressor.

In addition, in the known screw compressor disclosed in Patent Document 1, each of two compression mechanisms includes a screw rotor and gate rotors. Thus, the number of components forming the compression mechanisms is greater than that of a screw compressor for single-stage compression. In contrast, in this embodiment, the refrigerant can be compressed in two stages using the single screw rotor and the two gate rotors. This can reduce the number of components of the compression mechanism to a number equivalent to the number of components of a screw compressor for single-stage compression.

In this embodiment, the first space (S1) communicating with the first compression chamber (24) and the second space (S2) communicating with the second compression chamber (25) are formed around the cylindrical wall (16). The first space (S1), the first compression chamber (24), the second compression chamber (25), and the second space (S2) are connected together in an ascending order of the pressures of the fluid.

According to this configuration, the fluid in the first space (S1) is compressed in the first compression chamber (24), and is further compressed in the second compression chamber (25) and flows out to the second space (S2). The first space (S1) and the second space (S2) formed in the casing (10) of the screw compressor enable two-stage compression with a simple configuration.

In particular, in this embodiment, the cylindrical wall (16) has the slits (16*a*, 16*b*) through which the associated gates (51) pass. The slits (16*a*. 16*b*) include the first slit (16*a*) through which the first space (S1) communicates with the first compression chamber (24), and the second slit (16*b*) through which the second compression chamber (25) communicates with the second space (S2).

According to this configuration, the fluid circulates radially through the slits (16*a*, 16*b*) of the cylindrical wall (16) between the first space (S1) and the first compression chamber (24) and between the second compression chamber (25) and the second space (S2). With such a configuration, the inlet through which the fluid flows into each compression chamber (24, 25) can have a simple configuration. This can reduce an increase in the size of, and can simplify the configuration of, the screw compressor performing two-stage compression.

In addition, in this embodiment, each of the axial end portions of the screw rotor (40) has the scaling portion (42, 43) located between the cylindrical wall (16) and the screw rotor (40) and configured to reduce the circulation of the fluid.

According to this configuration, the sealing portions (42, 43) at both axial end portions of the screw rotor (40) can facilitate the configuration in which the fluid circulates between the first space (S1) and the first compression chamber (24) and between the second compression chamber (25) and the second space (S2) in the radial direction of the cylindrical wall (16), and can reduce an increase in the size of, and simplify the configuration of, the screw compressor performing two-stage compression.

In this embodiment, the ratio N1/N2 of the groove number N1 to the teeth number N2 is set to be greater than or equal to 3/5, where N1 represents the number of the screw grooves (41), and N2 represents the number of the teeth forming the gates (51). Specifically, the number N1 is set to be six, and the number N2 is set to be ten.

This configuration increases the helix angle of the screw grooves (41) (causes the helix angle to approach the axial direction from the direction perpendicular to the axis). Thus, in meshing the gate rotors (50) with the screw grooves (41) of the screw rotor (40), the gate rotors (50) can be assembled while being inclined more toward the axis of the screw rotor (40) than the state of completion of the assembly in which the gate rotors (50) are perpendicular to the axis of the screw rotor (40). This allows the gate rotors (50) to be easily assembled to the screw rotor (40).

In this embodiment, each gate rotor (50) is configured to include the gate body (54) meshing with the screw grooves (41), and the gate support (55) supporting the gate body (54) from the low-pressure side. According to this configuration, the gates (51) of each gate rotor (50) receive the load due to the differential pressure between the first compression chamber (24) and the second compression chamber (25), and the associated gate support (55) can receive that load. This reduces damage to the gate rotor (50). Instead of providing the gate support (55), the gate body (54) may be made of metal, or may be integrated with the gate support (55). Such a configuration can more effectively reduce damage to the gate rotor (50).

In this embodiment, the casing (10) has the motor chamber (9) in which the motor (5) driving the screw rotor (40) is housed, the introduction passage (13) through which the refrigerant at the intermediate pressure is introduced into the motor chamber (9), and the communication passage (14) through which the motor chamber (9) communicates with the second compression chamber (25).

According to this configuration, when the fluid compressed in the first compression chamber (24) is supplied to the second compression chamber (25), the fluid in the motor chamber (9) is also supplied to the second compression chamber (25). Thus, the economizer effect enhances the efficiency of the compressor.

Variations of First Embodiment

First Variation

In the screw compressor of the first embodiment, the suction volume of the second compression chamber (25) is set to be smaller than the suction volume of the first compression chamber (24) in one preferred embodiment. The reason for this is that the refrigerant compressed in the low-stage first compression chamber (24) can be efficiently compressed in the second compression chamber (25) with a suction volume smaller than that of the first compression chamber (24).

Figure 11:
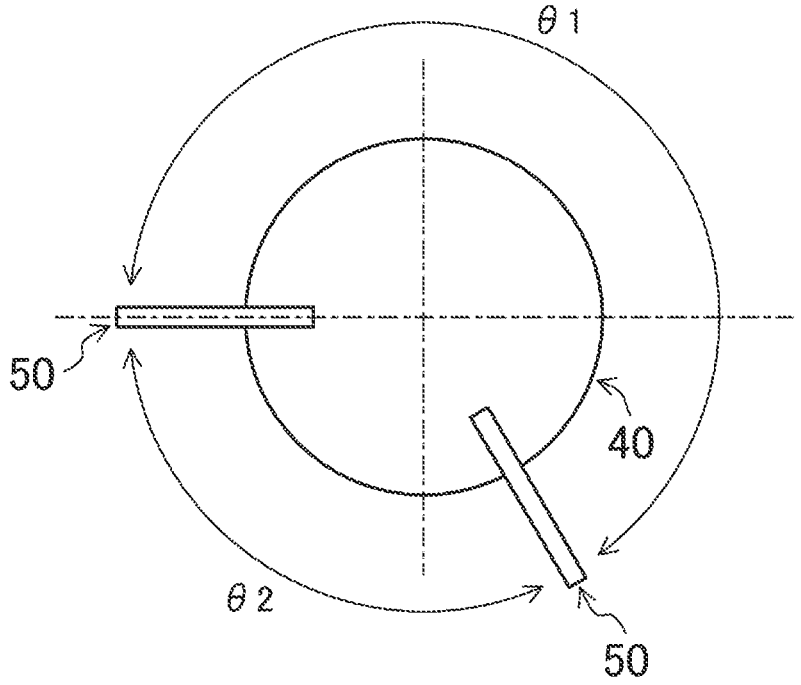
FIG. 11 is a schematic view showing the positional relationship between two gate rotors of a screw compressor according to a first variation.

Specifically, as shown in FIG. 11, a second central angle (θ2) formed by two gates (51) forming the second compression chamber (25) and the center of rotation of the screw rotor (40) is desired to be set to be smaller than a first central angle (θ1) formed by the two gates (51) forming the first compression chamber (24) and the center of rotation of the screw rotor (40).

A configuration in which the suction volume of the second compression chamber (25) is smaller than that of the first compression chamber (24) can be easily achieved by setting the second central angle (θ2) to be smaller than the first central angle (θ1).

Second Variation

Figure 12:
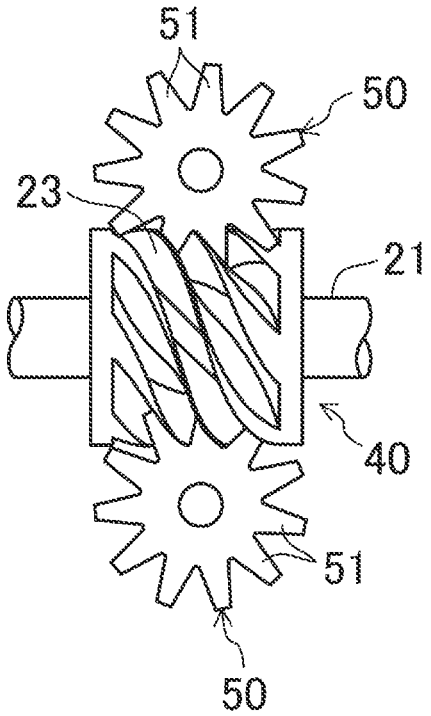
FIG. 12 is a diagram illustrating the shape of each of the gate rotors of a screw compressor according to a second variation.

A second variation shown in FIG. 12 is an example in which, in the screw compressor of the first embodiment, the gates (51) are formed such that the width of the teeth forming the gates (51) decreases from the inside to the outside in the radial direction of the gate rotors (50) as shown in FIG. 12.

Such a configuration facilitates meshing the gates (51) with the screw grooves (41) in assembling the gate rotors (50) to the screw rotor (40), and improves assemblability.

Second Embodiment

A second embodiment will be described below.

The second embodiment relates to a specific example of a mechanism for regulating the suction volume of the compression chamber (23), and the other configurations are common to those of the first embodiment.

Specifically, the second embodiment is an example in which a first regulation mechanism (81) configured to regulate the suction volume of the second compression chamber (25) is provided in FIG. 3. The first regulation mechanism (81) of the second embodiment includes a second slide valve (70*b*) and a driving mechanism (71).

The second slide valve (70*b*) constitutes an unloading mechanism configured to return a refrigerant that is being compressed in the second compression chamber (25) to the suction side to regulate the operating capacity. When the second slide valve (70*b*) is set to be in a fully loaded position to discharge the entire sucked refrigerant, the suction volume is maximized. When the position of the second slide valve (70*b*) is changed from the fully loaded position to the unloaded position to return a portion of the sucked refrigerant to the suction side, the apparent suction volume and the operating capacity decrease as compared to those in the fully loaded position.

Such a configuration allows the substantial suction volume of the second compression chamber (25) to be smaller than that of the first compression chamber (24). Thus, the proportion (volume ratio) between the suction volume of the first compression chamber (24) and the suction volume of the second compression chamber (25) can be set to be suitable for a two-stage compression refrigeration cycle. This enhances the operating efficiency for two-stage compression with a simple configuration using known slide valves.

If a first slide valve (70*a*) is further provided to enable regulation of the suction volume of the first compression chamber (24), the volume ratio can be more finely controlled than if only the second slide valve (70*b*) regulates the volume ratio.

Instead of the second slide valve (70*b*) configured to be capable of regulating the suction volume of the second compression chamber (25), the first slide valve (70*a*) may be provided to regulate the suction volume of only the first compression chamber (24).

Variations of Second Embodiment

First Variation

A first variation of the second embodiment is an example in which a second regulation mechanism (82) configured to regulate at least one of the suction volume of the first compression chamber (24) or the compression ratio of the second compression chamber (25) is provided in FIG. 3. In this first variation, the first regulation mechanism (81) includes the first slide valve (70*a*) and the driving mechanism (71), and the second regulation mechanism (82) includes the second slide valve (70*b*) and the driving mechanism (71).

The first regulation mechanism (81) constitutes an unloading mechanism configured to return a refrigerant that is being compressed in the first compression chamber (24) to the suction side to regulate the operating capacity. The first regulation mechanism (81) regulates the opening area of a first opening (84) formed in the cylindrical wall (16) by changing the position of the first slide valve (70*a*) in the axial direction of the screw rotor (40). When the first slide valve (70*a*) is set to be in a first position (fully loaded position) in which the entire sucked refrigerant is compressed, the suction volume is maximized. When the position of the first slide valve (70*a*) is changed to a second position (unloaded position) to return a portion of the sucked refrigerant to the suction side, the apparent suction volume and the operating capacity decrease as compared to those in the first position. The second position is a position including a predetermined range in which the suction volume is smaller than in the fully loaded first position.

The second regulation mechanism (82) constitutes a compression ratio regulation mechanism configured to change the timing of discharging a refrigerant from the second compression chamber (25) to regulate the compression ratio. The compression ratio (internal volume ratio) as used herein refers to the ratio between the suction volume and discharge volume of a compression chamber. The second regulation mechanism (82) regulates the opening area of a second opening (85) formed in the cylindrical wall (16) by changing the position of the second slide valve (70*b*) in the axial direction of the screw rotor (40). When the second slide valve (70*b*) is set to be in a first position (high-compression-ratio position), where the discharge timing is slow, the compression ratio increases. When the second slide valve (70*b*) is set to be in a second position (low-compression-ratio position), where the discharge timing is fast, the compression ratio is lower than in the first position. The second position is a position including a predetermined range in which the compression ratio is lower than in the first position of the high compression ratio.

Such a configuration can change the suction volume of the first compression chamber (24) and can change the compression ratio of the second compression chamber (25). Thus, the proportion between the suction volume of the first compression chamber (24) and the suction volume of the second compression chamber (25) and the compression ratios of these compression chambers can be set to be suitable for a two-stage compression refrigeration cycle. This enhances the operating efficiency for two-stage compression with a relatively simple configuration using the slide valves.

Second Variation

In the first variation of the second embodiment described above, one driving mechanism serves as the driving mechanism (71) for the first regulation mechanism (81) and as the driving mechanism (71) for the second regulation mechanism (82), as shown in FIG. 3. However, in a variation of the second embodiment, a driving mechanism for the first regulation mechanism (81) and a driving mechanism for the second regulation mechanism (82) may be provided separately.

This configuration enables separate control of the unloading and the internal volume ratio by the first regulation mechanism (81) and the second regulation mechanism (82), respectively. It is therefore possible to perform an operation that is more suitable for a two-stage compression refrigeration cycle.

Third Variation

In the second embodiment, if the suction volume of the second compression chamber (25) is set to be smaller than the suction volume of the first compression chamber (24), the opening area of the second opening (85) is set to be smaller than the opening area of the first opening (84) in one preferred embodiment.

This configuration can keep the control amount (sliding amount) of the second slide valve (70*b*) from increasing excessively relative to the second compression chamber (25) whose suction volume is small. In other words, this configuration facilitates the control of the second slide valve (70*b*) by the control amount in accordance with the suction volume of the second compression chamber (25).

Fourth Variation

In the second embodiment, the screw-compressor (1) may be configured to include the motor (5) driving the screw rotor (40) at a variable speed, and a first regulation mechanism (81) regulating at least one of the suction volume of the first compression chamber (24) or the suction volume of the second compression chamber (25). A configuration in which the motor (5) is driven by an inverter can be used as a configuration in which the screw rotor (40) is driven at a variable speed. The motor (5) may be connected to a mechanical variable speed gear to drive the screw rotor (40).

This configuration makes it possible that the operating capacity is controlled through rotation of the screw rotor (40) at a variable speed, and that the volume ratio between the first compression chamber (24) and the second compression chamber (25) is controlled by the first regulation mechanism (81). This enhances the operating efficiency for two-stage compression with a relatively simple configuration using the variable-speed driving gear and the slide valves (70).

Fifth Variation

In the second embodiment, the screw compressor (I) may be configured to include the motor (5) driving the screw rotor (40) at a variable speed, and a second regulation mechanism (82) regulating at least one of the compression ratio of the first compression chamber (24) or the compression ratio of the second compression chamber (25). A configuration in which the motor (5) is driven by an inverter can be used as a configuration in which the screw rotor (40) is driven at a variable speed. The motor (5) may be connected to a mechanical variable speed gear to drive the screw rotor (40).

This configuration makes it possible that the operating capacity is controlled through rotation of the screw rotor (40) at a variable speed, and that the first regulation mechanism (81) controls the compression ratio of the compression mechanism (20) as a whole. This enhances the operating efficiency for two-stage compression with a relatively simple configuration using the variable-speed driving gear and the slide valves (70).

Third Embodiment of the Invention

A third embodiment will be described below.

Figure 13:
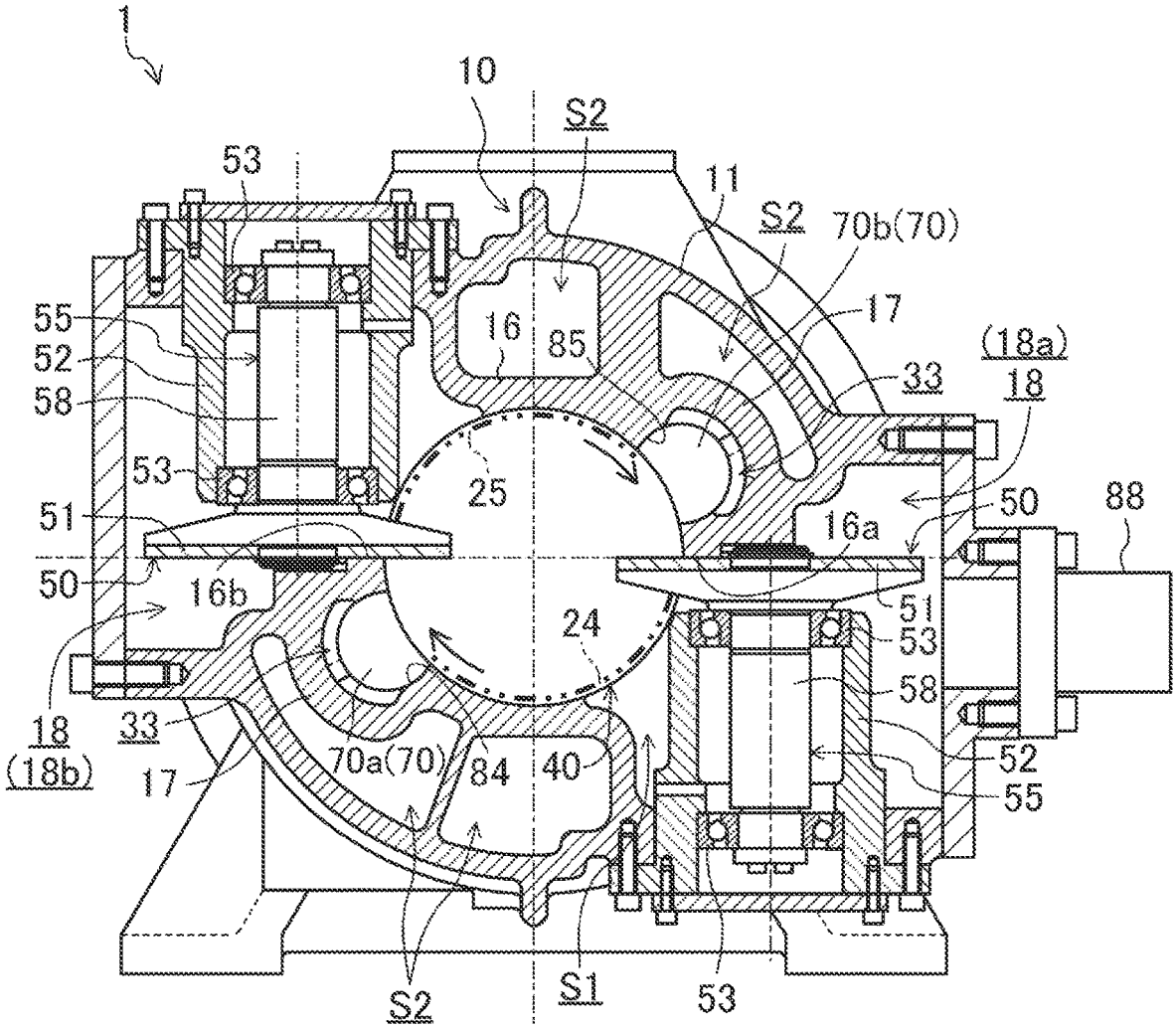
FIG. 13 is a cross-sectional view of a compression mechanism of a screw compressor according to a third embodiment as viewed in an axial direction.

As shown in FIG. 13, a first gate rotor chamber (18*a*) is connected to a low-pressure pipe (88) through which a low-pressure refrigerant flows. The first gate rotor chamber (18*a*) to which the low-pressure refrigerant is supplied from the low-pressure pipe (88) serves as a low-pressure space (S1). The first gate rotor chamber (18*a*) is configured to supply the low-pressure refrigerant to the inlet of a first compression chamber (24). The low-pressure refrigerant is compressed in the first compression chamber (24) to be an intermediate-pressure refrigerant.

Figure 14:
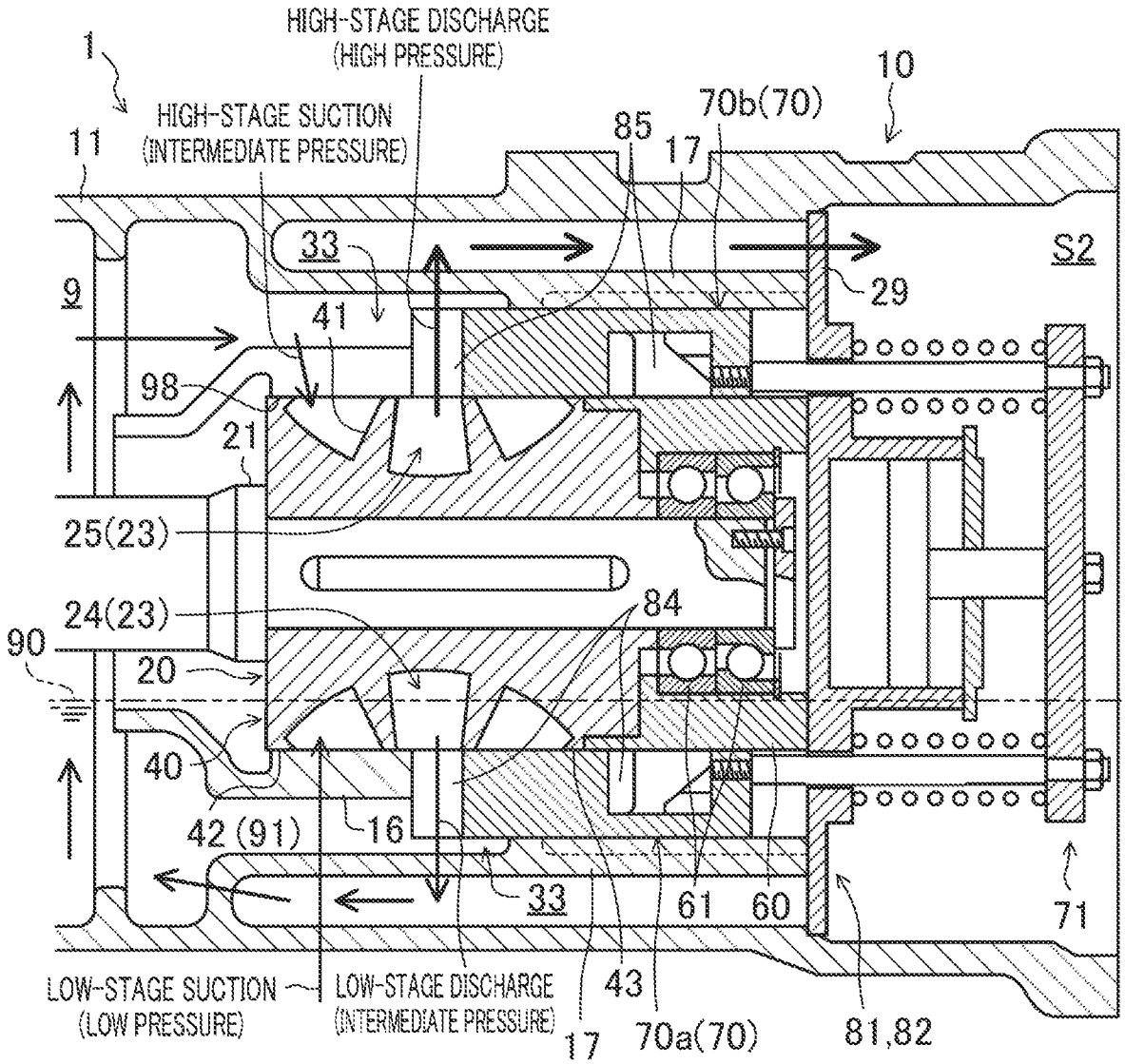
FIG. 14 is a side cross-sectional view illustrating a flow of a refrigerant in the compression mechanism.

As shown in FIG. 14, the intermediate-pressure refrigerant compressed in the first compression chamber (24) to the intermediate pressure is supplied to a motor chamber (9) (suction chamber).

Figure 15:
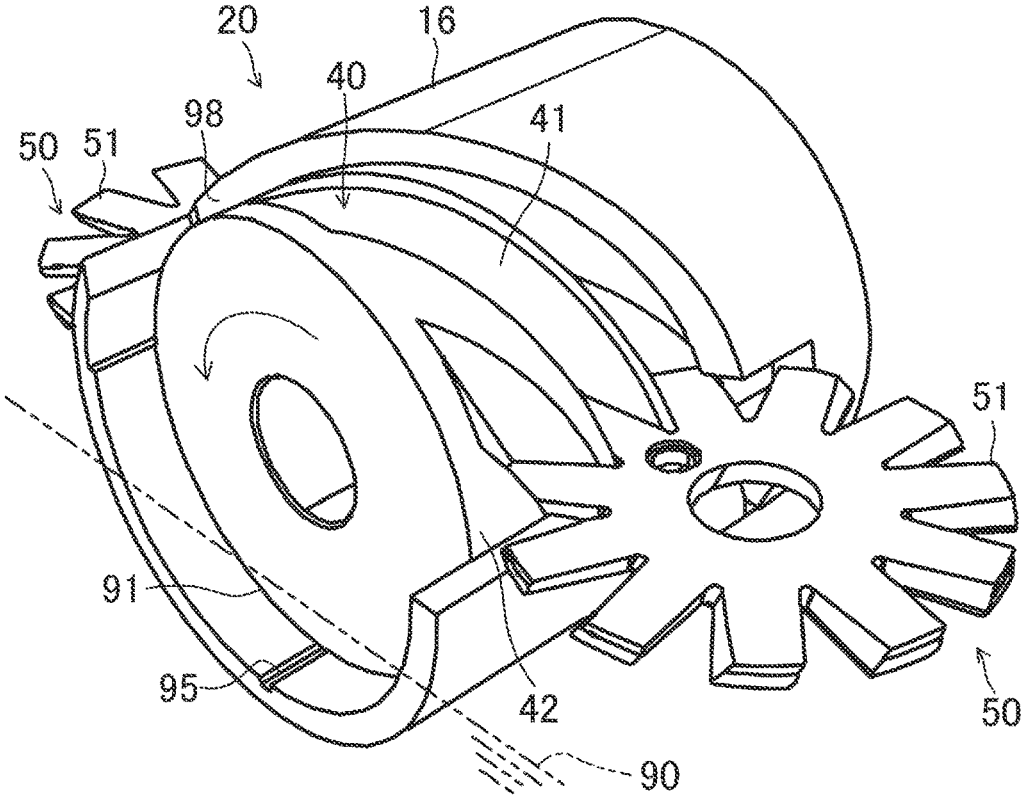
FIG. 15 is a perspective view illustrating the configuration of the compression mechanism.

An axial end portion of a cylindrical wall (16) near the motor chamber (9) has a sealing portion (91) and a cut-out (98) (see also FIG. 15). An oil film is formed between the sealing portion (91) and a first end portion (42) of a screw rotor (40) which serves as a sealing surface of the screw rotor (40). The sealing portion (91) reduces the circulation of the refrigerant between the cylindrical wall (16) and the first compression chamber (24) of the screw rotor (40).

The cut-out (98) is formed by cutting out a portion of the cylindrical wall (16). The motor chamber (9) and a second compression chamber (25) communicate with each other through the cut-out (98). The intermediate-pressure refrigerant flowing through the motor chamber (9) is supplied through the cut-out (98) of the cylindrical wall (16) to the suction opening of the second compression chamber (25). The intermediate-pressure refrigerant is compressed in the second compression chamber (25) to be a high-pressure refrigerant.

The high-pressure refrigerant compressed in the second compression chamber (25) to the high pressure is supplied to a high-pressure space (S2). The high-pressure refrigerant flowing through the high-pressure space (S2) is discharged from the outlet (10*b*) of the casing (10) (see FIG. 1).

As shown in FIGS. 14 and 15, an oil reservoir (90) in which oil is stored is provided in the casing (10). The oil reservoir (90) is provided across the motor chamber (9) and the first compression chamber (24).

The sealing portion (91) is formed between the first end portion (42) of the screw rotor (40) near the motor chamber (9) and the inner peripheral surface of the cylindrical wall (16). The sealing portion (91) reduces the circulation of the refrigerant between the motor chamber (9) and the first compression chamber (24). The sealing portion (91) is immersed in oil in the oil reservoir (90).

Figure 16:
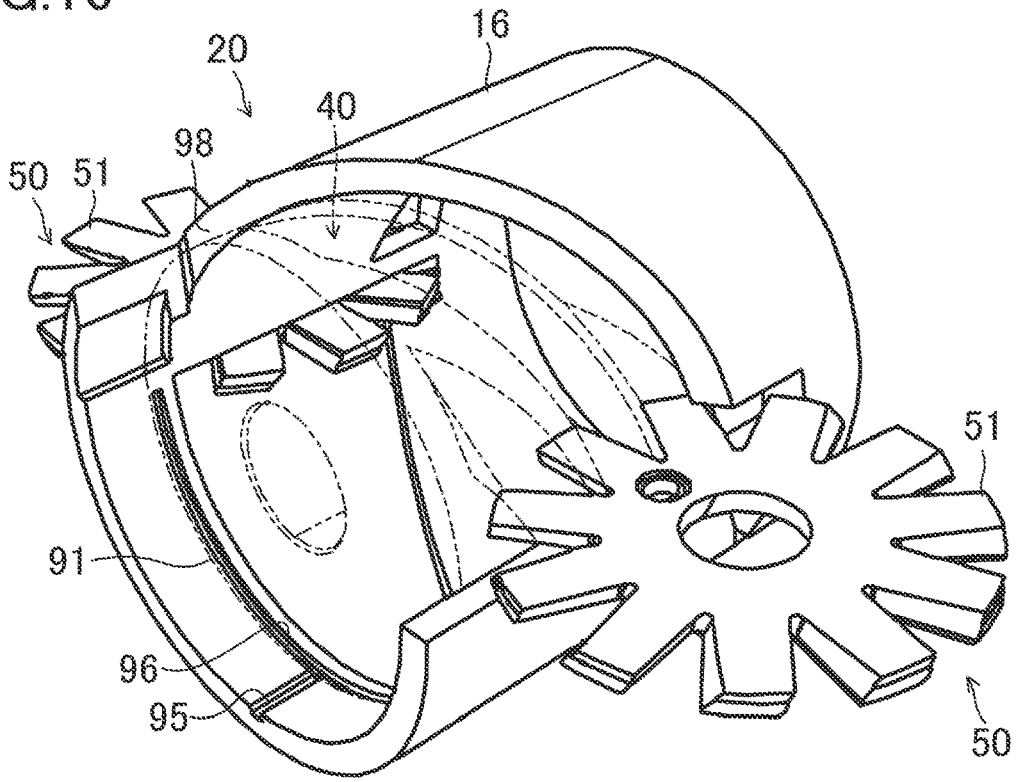
FIG. 16 is a perspective view illustrating the configurations of a first groove and a second groove.
Figure 17:
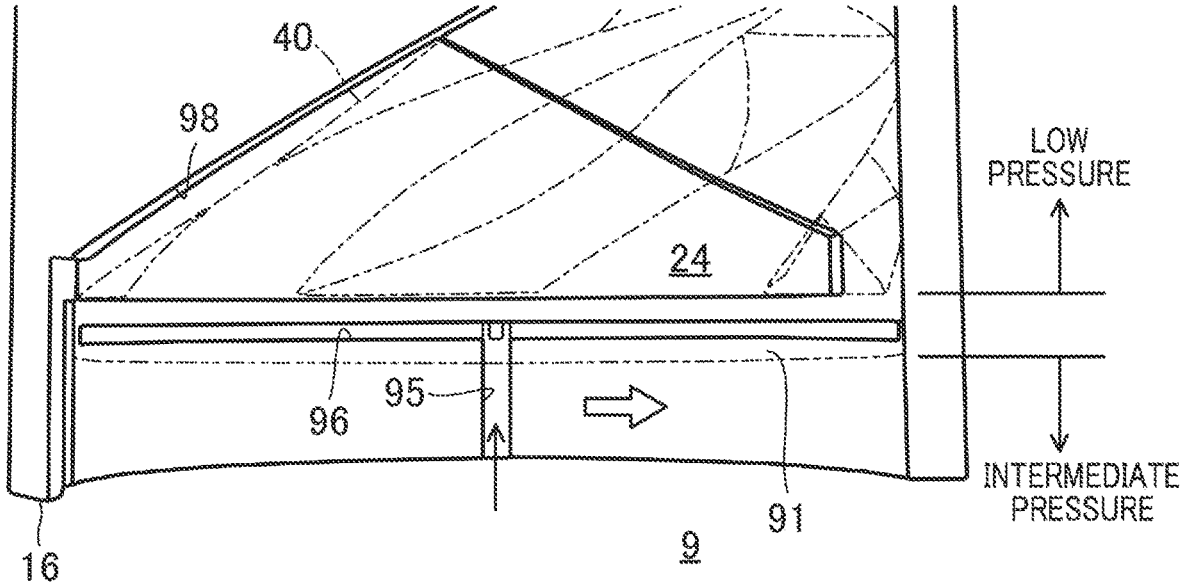
FIG. 17 is a plan view illustrating the configurations of the first groove and the second groove.

As shown in FIGS. 16 and 17, the cylindrical wall (16) has a first groove (95) and a second groove (96). The first groove (95) extends axially from a position overlapping the sealing portion (91). The second groove (96) extends circumferentially at the position overlapping the sealing portion (91), and communicates with the first groove (95).

The depth of the second groove (96) may be substantially uniform along the circumferential direction, or may be changed at an intermediate point along the circumferential direction. For example, the depth of the second groove (96) may be gradually reduced in the direction of rotation of the screw rotor (40).

An axial end portion of the first groove (95) opens toward the motor chamber (9). The intermediate-pressure refrigerant flows through the motor chamber (9). The low-pressure refrigerant flows through the first compression chamber (24). The oil in the oil reservoir (90) flows through the first groove (95) toward the second groove (96) due to the pressure difference between the motor chamber (9) and the first compression chamber (24). Thus, oil can be supplied to the sealing portion (91) to form an oil film.

Advantages of Third Embodiment

According to a feature of this embodiment, the oil reservoir (90) is provided in the casing (10). The motor chamber (9) communicates with the suction opening of one of the first compression chamber (24) or the second compression chamber (25) included in the compression chambers (23). The sealing portion (91) is provided between the cylindrical wall (16) and the screw rotor (40). The scaling portion (91) reduces the circulation of the refrigerant between the motor chamber (9) and the other compression chamber (23), which is the other one of the first compression chamber (24) or the second compression chamber (25). At least a portion of the sealing portion (91) is immersed in oil in the oil reservoir (90).

Immersing at least a portion of the sealing portion (91) in the oil in the oil reservoir (90) makes it possible to form the oil film on the sealing portion (91). This improves the sealing performance.

According to a feature of this embodiment, the first groove (95) is provided on the inner peripheral surface of the cylindrical wall (16). The first groove (95) extends axially from a position overlapping the sealing portion (91). An axial end portion of the first groove (95) is open to the suction chamber (9) or a space having a higher pressure in one of the compression chambers (23) sealed by the sealing portion (91).

Thus, the oil can be supplied from the first groove (95) to the sealing portion (91) by the pressure difference between the motor chamber (9) and the compression chamber (23). This improves the sealing performance.

According to a feature of this embodiment, the second groove (96) is provided on the inner peripheral surface of the cylindrical wall (16). The second groove (96) extends circumferentially at the position overlapping the sealing portion (91), and communicates with the first groove (95).

Thus, the oil supplied from the first groove (95) to the second groove (96) can form the oil film along the circumferential direction of the sealing portion (91). This improves the sealing performance.

Variations of Third Embodiment

First Variation

In the third embodiment, a portion of the sealing portion (91) may be immersed in oil in the oil reservoir (90).

Figure 18:
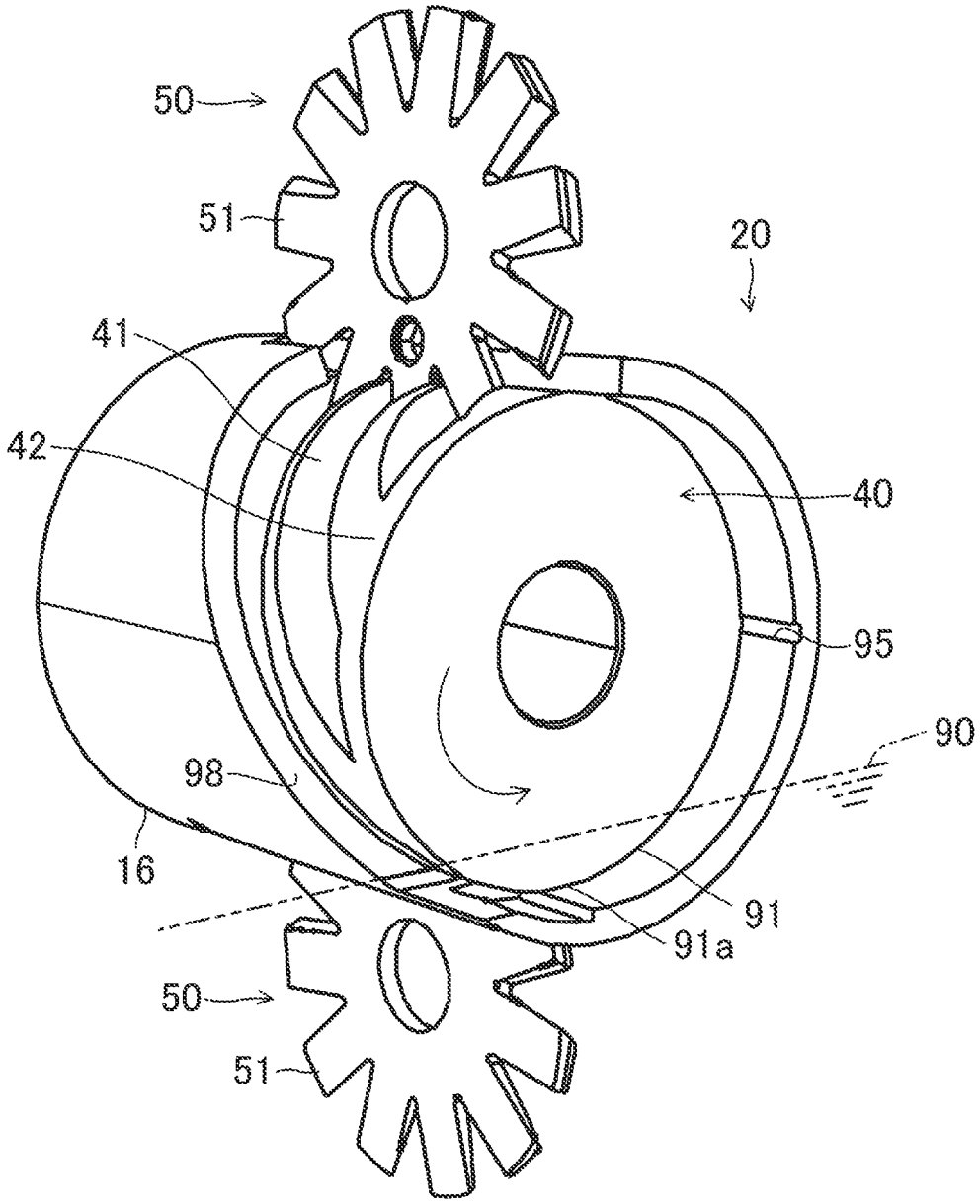
FIG. 18 is a perspective view illustrating the configuration of a compression mechanism according to a first variation of the third embodiment.
Figure 19:
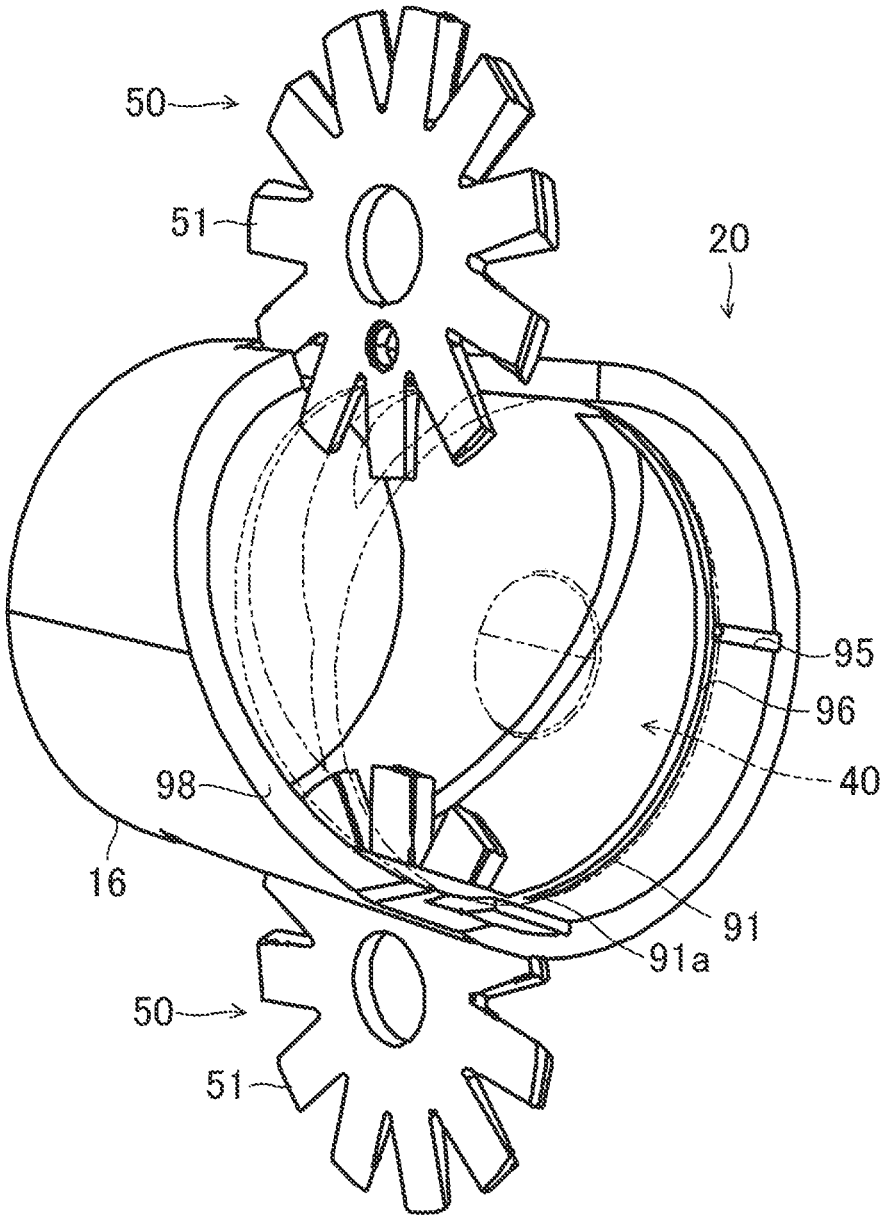
FIG. 19 is a perspective view illustrating the configurations of a first groove and a second groove.

Specifically, as shown in FIGS. 18 and 19, the sealing portion (91) of the cylindrical wall (16) includes a sealing start portion (91*a*). The sealing start portion (91*a*) is a portion where the first end portion (42) of the screw rotor (40) exposed from the cut-out (98) of the cylindrical wall (16) starts overlapping with the sealing portion (91) in accordance with the rotation of the screw rotor (40).

The sealing start portion (91*a*) of the cylindrical wall (16) is immersed in the oil in the oil reservoir (90). Specifically, the screw rotor (40) rotates counterclockwise in FIG. 18. The compression mechanism (20) is in the position in which the cut-out (98) of the cylindrical wall (16) is located on the left side of FIG. 18, and the sealing portion (91) of the cylindrical wall (16) is located on the right side of FIG. 18. The sealing start portion (91*a*) is located on the lower side of FIG. 18. The sealing start portion (91*a*) is immersed in the oil in the oil reservoir (90).

The oil supplied from the oil reservoir (90) to the sealing start portion (91*a*) is supplied in the circumferential direction along the second groove (96) of the cylindrical wall (16) in accordance with the rotation of the screw rotor (40).

Advantages of First Variation

According to a feature of this variation, the sealing portion (91) of the cylindrical wall (16) includes the sealing start portion (91*a*). The sealing start portion (91*a*) is a portion where the sealing surface of the screw rotor (40) that is rotating starts overlapping with the sealing portion (91). The sealing start portion (91*a*) is immersed in the oil in the oil reservoir (90).

Immersing the sealing start portion (91*a*) of the cylindrical wall (16) in the oil in the oil reservoir (90) makes it possible to form the oil film on the sealing portion (91) in accordance with the rotation of the screw rotor (40). This improves the sealing performance.

Even if the amount of the oil stored in the oil reservoir (90) is so small that the oil does not reach the height position of the first groove (95), scooping up the oil in accordance with the rotation of the screw rotor (40) facilitates supplying the oil to the entire surface of the sealing portion (91).

Second Variation

In the third embodiment, the second compression chamber (25) may be sealed by the sealing portion (91).

Figure 20:
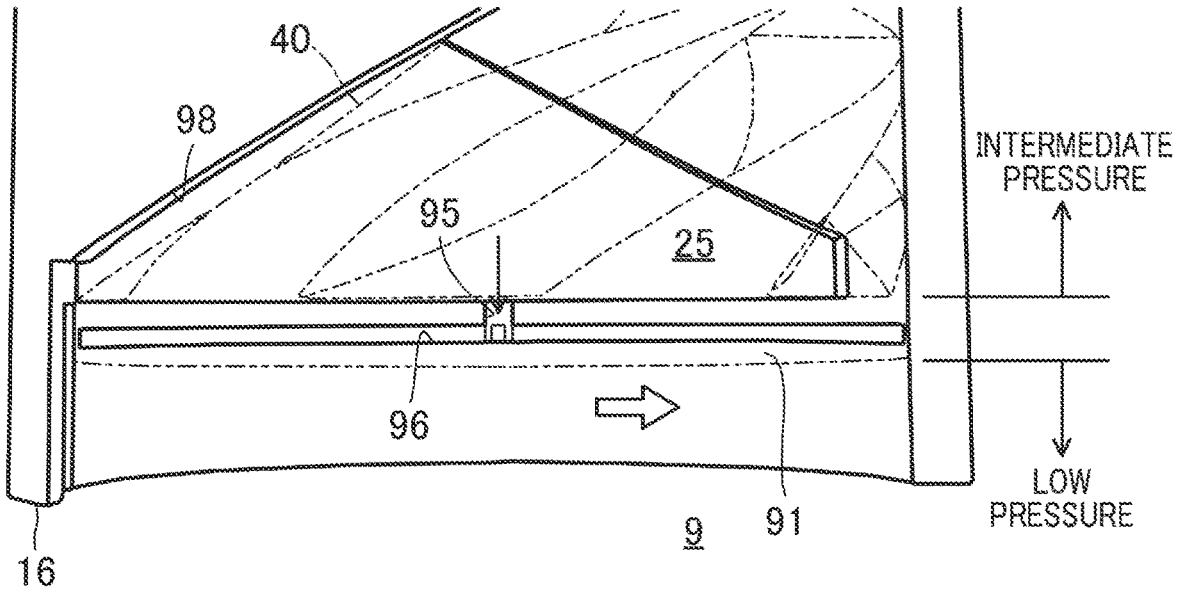
FIG. 20 is a plan view illustrating the configurations of a first groove and a second groove according to a second variation of the third embodiment.

As shown in FIG. 20, the low-pressure refrigerant flows through the motor chamber (9). The first compression chamber (24) communicates with the motor chamber (9) through the cut-out (98). The sealing portion (91) reduces the circulation of the refrigerant between the second compression chamber (25) and the motor chamber (9). The intermediate-pressure refrigerant flows through the second compression chamber (25).

An axial end portion of the first groove (95) opens toward the second compression chamber (25). The oil in the oil reservoir (90) flows through the first groove (95) toward the second groove (96) due to the pressure difference between the motor chamber (9) and the second compression chamber (25). Thus, oil can be supplied to the sealing portion (91) to form an oil film.

Third Variation

In the third embodiment, a plurality of third grooves (97) may be formed.

Figure 21:
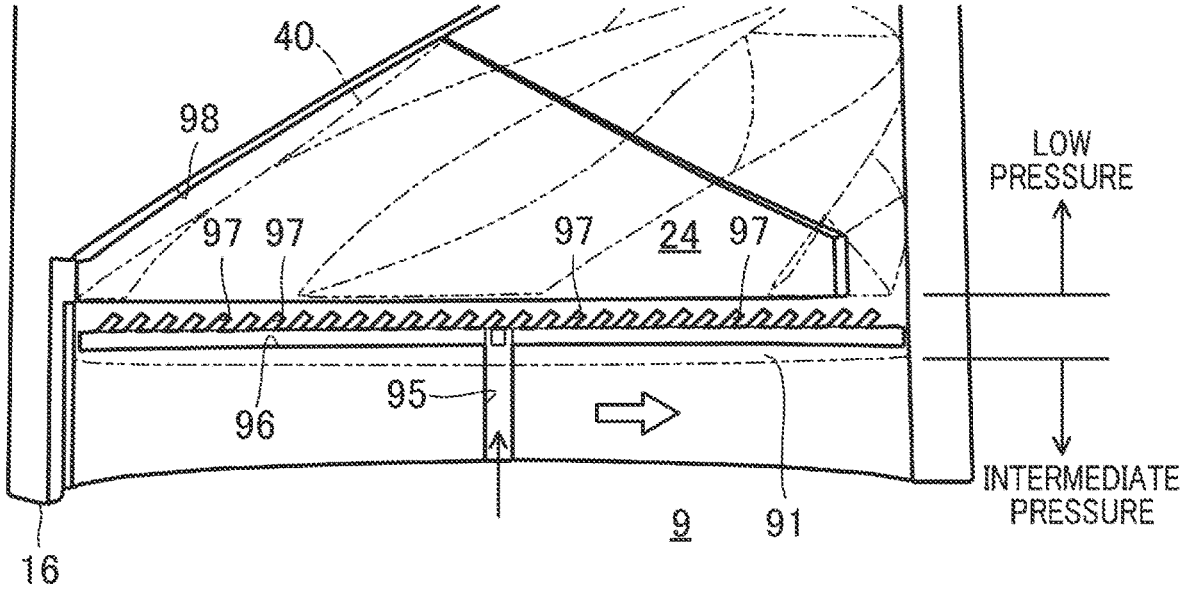
FIG. 21 is a plan view illustrating the configurations of a first groove and a second groove according to a third variation of the third embodiment.

As shown in FIG. 21, the cylindrical wall (16) has a first groove (95), a second groove (96), and the third grooves (97).

The first groove (95) extends axially from a position overlapping the sealing portion (91). An axial end portion of the first groove (95) opens toward the motor chamber (9). The second groove (96) extends circumferentially at the position overlapping the sealing portion (91), and communicates with the first groove (95).

The plurality of third grooves (97) are formed at intervals in the circumferential direction at positions overlapping the sealing portion (91). The third grooves (97) are provided at opposite side to the first groove (95) with respect to the second groove (96). The third grooves (97) extend in an inclined direction inclined at a predetermined angle with respect to the axial direction. The inclined direction is a direction along the direction of rotation of the screw rotor (40). In FIG. 21, the direction of rotation of the screw rotor (40) is the rightward direction. Thus, the third grooves (97) extend diagonally toward the upper right.

Thus, the oil in the oil reservoir (90) can be supplied to a large area of the sealing portion (91) in accordance with the rotation of the screw rotor (40).

Fourth Embodiment of the Invention

A fourth embodiment will be described below.

Figure 22:
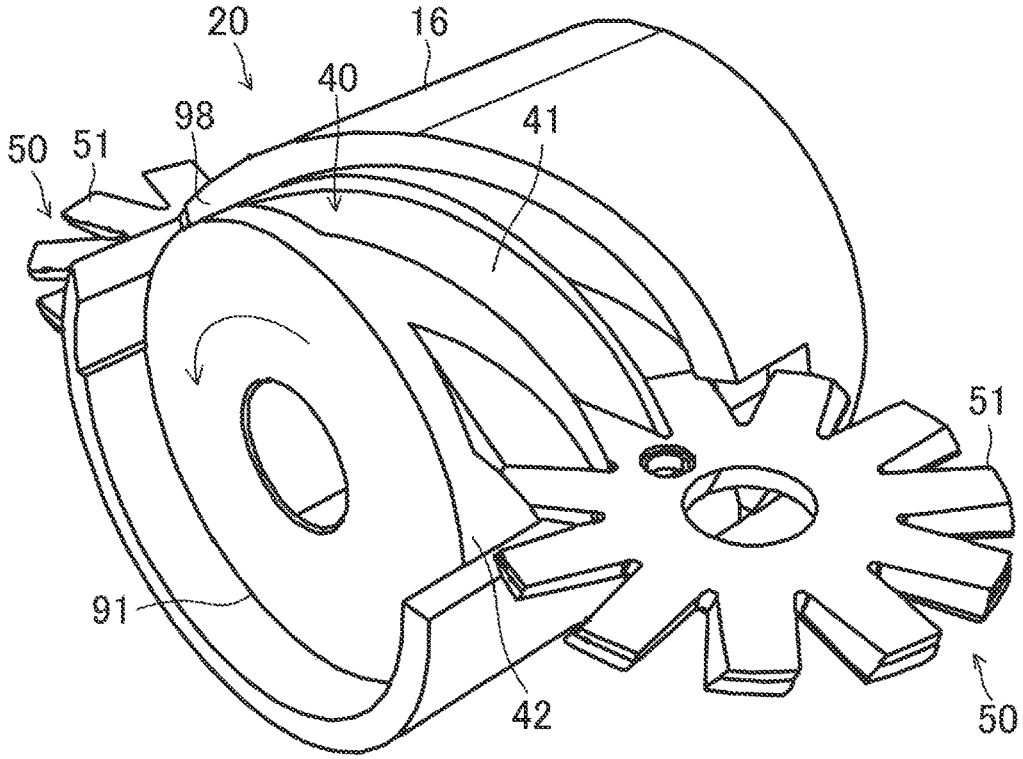
FIG. 22 is a perspective view illustrating the configuration of a compression mechanism of a screw compressor according to a fourth embodiment.
Figure 23:
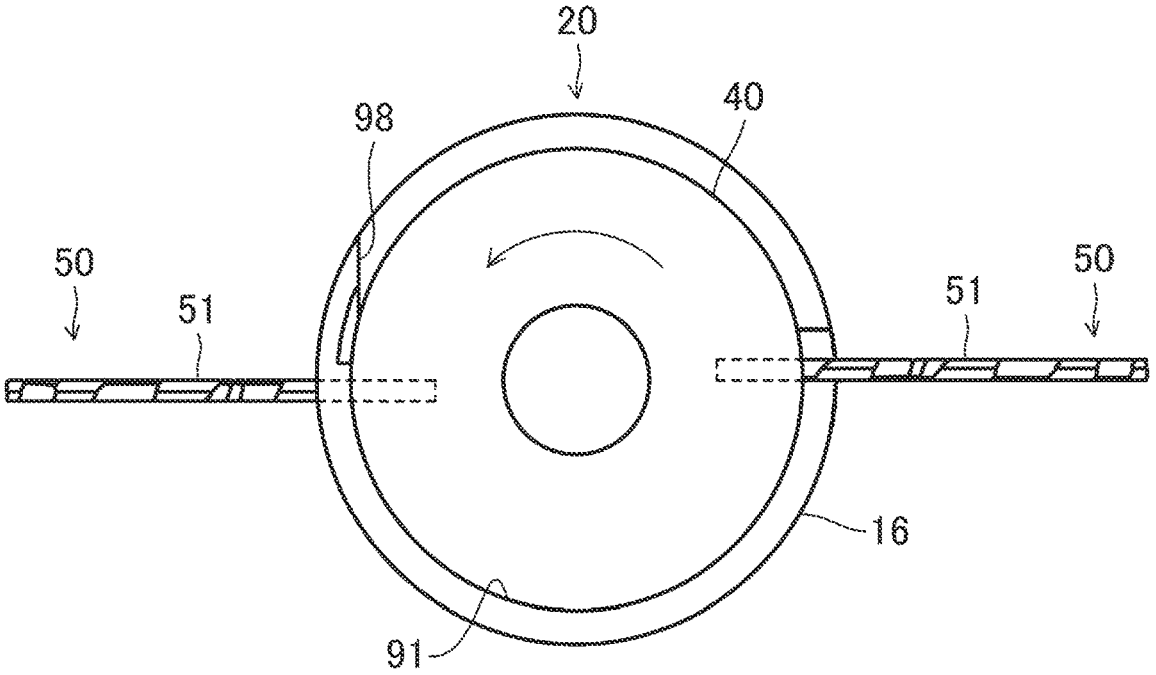
FIG. 23 is a diagram illustrating the compression mechanism as viewed in an axial direction.

As shown in FIGS. 22 and 23, an end portion of a cylindrical wall (16) near a motor chamber (9) has a sealing portion (91) and a cut-out (98). A low-pressure refrigerant is supplied to a first compression chamber (24) (see FIG. 14). The sealing portion (91) reduces the circulation of the refrigerant between the cylindrical wall (16) and the first compression chamber (24) of the screw rotor (40).

The cut-out (98) is formed by cutting out a portion of the cylindrical wall (16). The motor chamber (9) and a second compression chamber (25) communicate with each other through the cut-out (98).

As shown in FIG. 14, the intermediate-pressure refrigerant compressed in the first compression chamber (24) to an intermediate pressure is supplied to the motor chamber (9). The intermediate-pressure refrigerant flowing through the motor chamber (9) is supplied through the cut-out (98) of the cylindrical wall (16) to the suction opening of the second compression chamber (25). The intermediate-pressure refrigerant is compressed in the second compression chamber (25) to be a high-pressure refrigerant. The high-pressure refrigerant compressed in the second compression chamber (25) to the high pressure is supplied to a high-pressure space (S2).

Advantages of Fourth Embodiment

According to a feature of this embodiment, the cylindrical wall (16) has the cut-out (98). The sealing portion (91) is provided between the cylindrical wall (16) and the screw rotor (40). The motor chamber (9) and one of the first compression chamber (24) or the second compression chamber (25) included in the compression chambers (23) communicate with each other through the cut-out (98). The sealing portion (91) reduces the circulation of the fluid between the motor chamber (9) and the other compression chamber (23), which is the other one of the first compression chamber (24) or the second compression chamber (25).

As described above, since the motor chamber (9) and the second compression chamber (25) communicating with the motor chamber (9) communicate with each other through the cut-out (98), the formation of an oil film in an area where the sealing portion (91) is not needed is reduced. It is therefore possible to reduce the sliding loss due to the shear viscosity of oil during the rotation of the screw rotor (40), and improve the efficiency of the compressor.

Variation of Fourth Embodiment

In the fourth embodiment, the inner peripheral surface of the cylindrical wall (16) may have a recessed portion (99).

Figure 24:
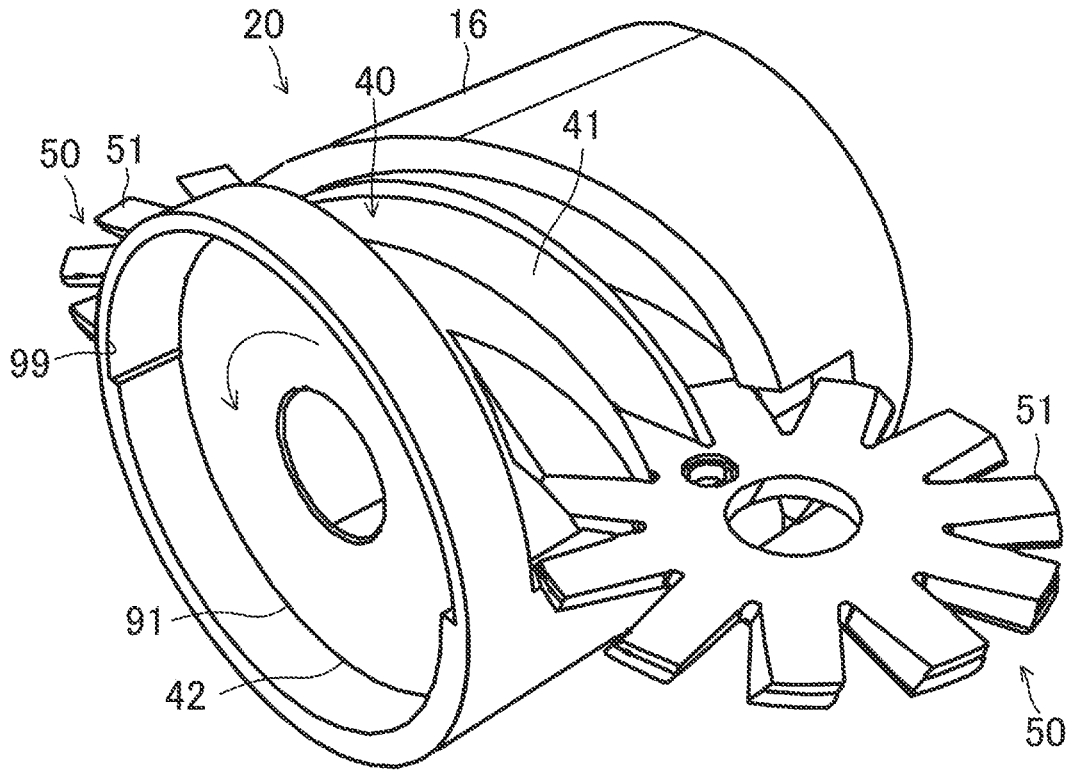
FIG. 24 is a perspective view illustrating the configuration of a compression mechanism according to a variation of the fourth embodiment.
Figure 25:
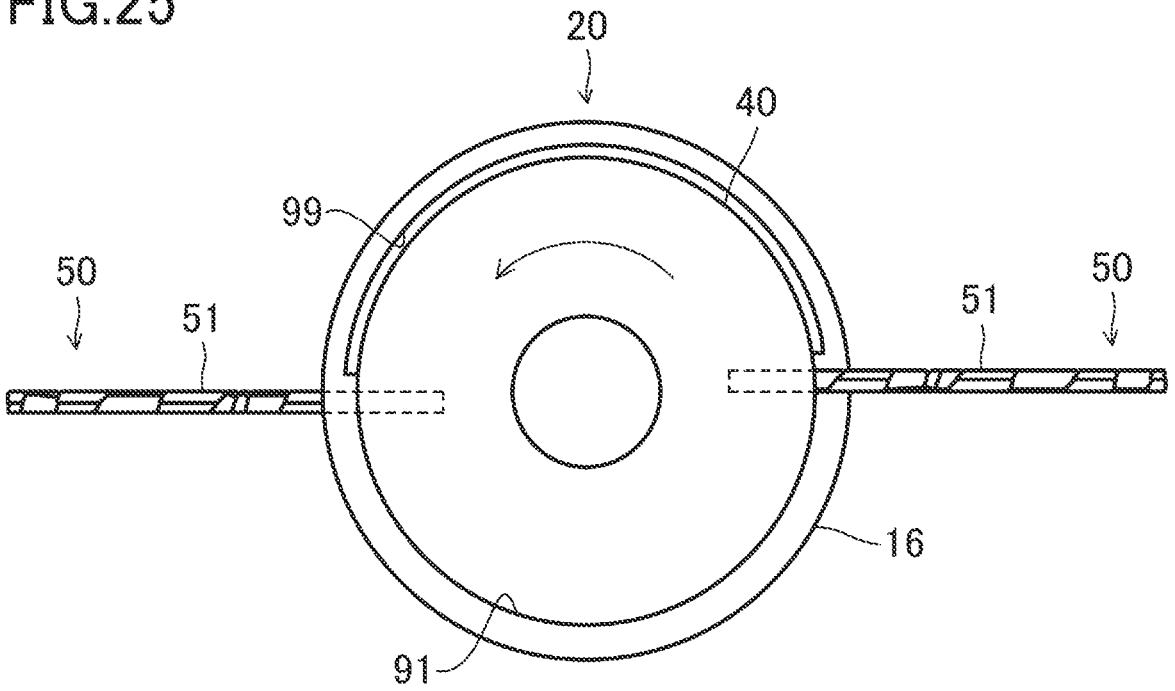
FIG. 25 is a diagram illustrating the compression mechanism as viewed in an axial direction.

As shown in FIGS. 24 and 25, an end portion of the cylindrical wall (16) near the motor chamber (9) has the scaling portion (91) and the recessed portion (99). A low-pressure refrigerant is supplied to a first compression chamber (24) (see FIG. 14). The sealing portion (91) reduces the circulation of the refrigerant between the cylindrical wall (16) and the first compression chamber (24) of the screw rotor (40).

The recessed portion (99) is formed by recessing a portion of the inner peripheral surface of the cylindrical wall (16). The recessed portion (99) extends circumferentially along the inner peripheral surface of the cylindrical wall (16). The recessed portion (99) is open toward the axis. A gap is formed between the portion of the cylindrical wall (16) where the recessed portion (99) is formed and the first end portion (42) of the screw rotor (40). The motor chamber (9) and the second compression chamber (25) communicate with each other through the recessed portion (99).

Advantages of Variation

According to a feature of this variation, the cylindrical wall (16) has the recessed portion (99). The sealing portion (91) is provided between the cylindrical wall (16) and the screw rotor (40). The motor chamber (9) and one of the first compression chamber (24) or the second compression chamber (25) included in the compression chambers (23) communicate with each other through the recessed portion (99). The sealing portion (91) reduces the circulation of the fluid between the motor chamber (9) and the other compression chamber (23), which is the other one of the first compression chamber (24) or the second compression chamber (25).

As described above, since the motor chamber (9) and the second compression chamber (25) communicating with the motor chamber (9) communicate with each other through the recessed portion (99), the formation of an oil film in an area where the sealing portion (91) is not needed is reduced. It is therefore possible to reduce the sliding loss due to the shear viscosity of oil during the rotation of the screw rotor (40), and improve the efficiency of the compressor.

In addition, the end portion of the cylindrical wall (16) near the motor chamber (9) is uninterruptedly continuous around the entire perimeter. It is therefore possible to ensure greater rigidity than in a case in which the end portion of the cylindrical wall (16) is partially cut out.

Fifth Embodiment of the Invention

A fifth embodiment will be described below.

Figure 26:
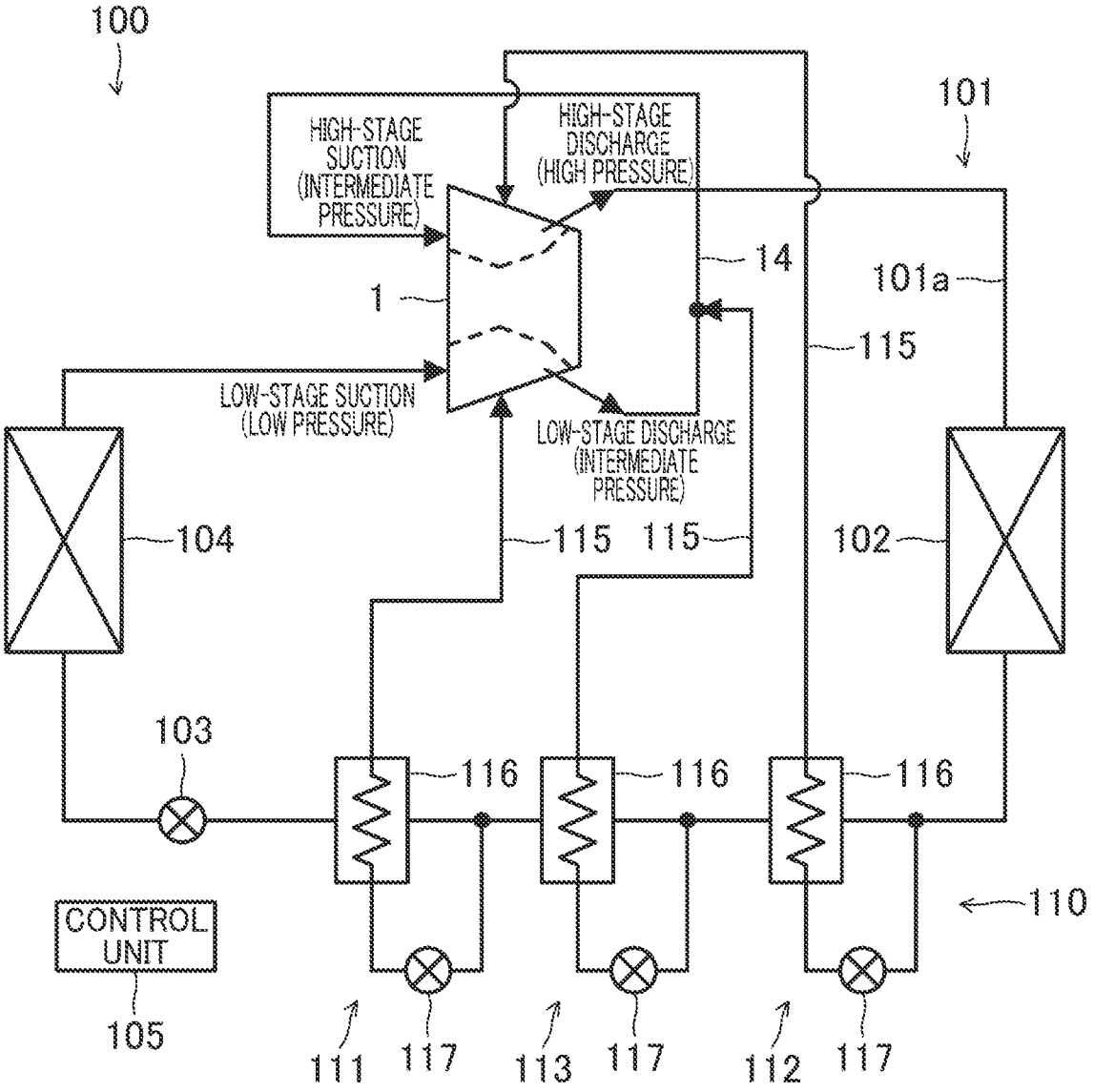
FIG. 26 is a refrigerant circuit diagram showing a flow of a refrigerant through a refrigeration apparatus according to a fifth embodiment.

As shown in FIG. 26, a refrigeration apparatus (100) includes a screw compressor (1), a refrigerant circuit (101), an economizer circuit (110), and a control unit (105). The refrigerant circuit (101) circulates a fluid therethrough to perform a refrigeration cycle. The screw compressor (1), a condenser (102), an expansion valve (103), and an evaporator (104) are connected to the refrigerant circuit (101) through a refrigerant pipe (101*a*).

The economizer circuit (110) causes the fluid to diverge from an intermediate point of the refrigerant circuit (101), and supplies the fluid into a compression chamber (23) in course of compression. The economizer circuit (110) is connected to the refrigerant pipe (101*a*) connecting the condenser (102) and the expansion valve (103).

The economizer circuit (110) includes a first economizer circuit (111), a second economizer circuit (112), and a third economizer circuit (113).

The first economizer circuit (111) includes a branch passage (115), a heat exchange section (116), and a switching section (117). The upstream end of the branch passage (115) is connected to the refrigerant pipe (101*a*) through which a liquid refrigerant flows. The downstream end of the branch passage (115) is connected to a first compression chamber (24) of the screw compressor (1).

The switching section (117) is configured as an electronic expansion valve having a variable opening degree, for example. The switching section (117) is connected to the branch passage (115). The heat exchange section (116) is connected to a portion of the branch passage (115) downstream of the switching section (117). The switching section (117) permits or blocks the circulation of the fluid through the branch passage (115). The switching section (117) adjusts the valve opening degree to reduce the flow rate of the fluid flowing through the branch passage (115).

The fluid flowing through the branch passage (115) exchanges heat with the liquid refrigerant flowing through the refrigerant pipe (101*a*) in the heat exchange section (116) to evaporate. The fluid that has evaporated in the heat exchange section (116) is supplied to the first compression chamber (24) through the branch passage (115).

The second economizer circuit (112) includes a branch passage (115), a heat exchange section (116), and a switching section (117). The upstream end of the branch passage (115) is connected to the refrigerant pipe (101*a*) through which the liquid refrigerant flows. The downstream end of the branch passage (115) is connected to a second compression chamber (25) of the screw compressor (1).

The switching section (117) is configured as an electronic expansion valve having a variable opening degree, for example. The switching section (117) is connected to the branch passage (115). The heat exchange section (116) is connected to a portion of the branch passage (115) downstream of the switching section (117). The switching section (117) permits or blocks the circulation of the fluid through the branch passage (115). The switching section (117) adjusts the valve opening degree to reduce the flow rate of the fluid flowing through the branch passage (115).

The fluid flowing through the branch passage (115) exchanges heat with the liquid refrigerant flowing through the refrigerant pipe (101*a*) in the heat exchange section (116) to evaporate. The fluid that has evaporated in the heat exchange section (116) is supplied to the second compression chamber (25) through the branch passage (115).

The third economizer circuit (113) includes a branch passage (115), a heat exchange section (116), and a switching section (117). The upstream end of the branch passage (115) is connected to the refrigerant pipe (101*a*) through which the liquid refrigerant flows. The downstream end of the branch passage (115) is connected to a communication passage (14) connecting the discharge side of the first compression chamber (24) and the suction side of the second compression chamber (25) of the screw compressor (1). The intermediate-pressure refrigerant flows through the communication passage (14).

The switching section (117) is configured as an electronic expansion valve having a variable opening degree, for example. The switching section (117) is connected to the branch passage (115). The heat exchange section (116) is connected to a portion of the branch passage (115) downstream of the switching section (117). The switching section (117) permits or blocks the circulation of the fluid through the branch passage (115). The switching section (117) adjusts the valve opening degree to reduce the flow rate of the fluid flowing through the branch passage (115).

The fluid flowing through the branch passage (115) exchanges heat with the liquid refrigerant flowing through the refrigerant pipe (101*a*) in the heat exchange section (116) to evaporate. The fluid that has evaporated in the heat exchange section (116) is supplied to the communication passage (14) through the branch passage (115).

The control unit (105) controls supply operations of the first economizer circuit (111) and the second economizer circuit (112) based on information indicating the operating state of the screw compressor (1). The information indicating the operating state of the screw compressor (1) is, for example, the outdoor air temperature.

Here, in a first state where the compression ratio of the screw compressor (1) is high, such as in a situation where a heating operation or a hot-water supply operation is performed under the conditions where the outdoor air temperature is low, e.g., below freezing, the control unit (105) controls the switching sections (117) of the first economizer circuit (111) and the second economizer circuit (112) to be open. In the first state, the refrigerant is supplied from the first economizer circuit (111) and the second economizer circuit (112) to the first compression chamber (24) and the second compression chamber (25) of the screw compressor (1).

In a second state where the outdoor air temperature is higher than that in the first state, and where the compression ratio of the screw compressor (1) is lower than that in the first state, the control unit (105) controls the switching section (117) of one of the first economizer circuit (111) or the second economizer circuit (112) to be open. In the second state, the refrigerant is supplied from the first economizer circuit (111) or the second economizer circuit (112) to the first compression chamber (24) or the second compression chamber (25) of the screw compressor (1).

In a third state where the compression ratio of the screw compressor (1) is lower than that in the second state, the control unit (105) controls the switching sections (117) of the first economizer circuit (111) and the second economizer circuit (112) to be closed. In the third state, the refrigerant is not supplied from the first economizer circuit (111) and the second economizer circuit (112) to the first compression chamber (24) and the second compression chamber (25) of the screw compressor (1).

Advantages of Fifth Embodiment

According to a feature of this embodiment, the economizer circuit (110) causes the fluid to diverge from an intermediate point of the refrigerant circuit (101), and supplies the fluid into at least one of the first compression chamber (24) or the second compression chamber (25) in course of compression. This can increase the amount of the fluid supplied to the compression chamber (23), and can improve the performance of the compressor.

According to a feature of this embodiment, the economizer circuit (110) includes the first economizer circuit (111) and the second economizer circuit (112). The first economizer circuit (111) is connected to the first compression chamber (24). The second economizer circuit (112) is connected to the second compression chamber (25). The control unit (105) controls supply operations of the first economizer circuit (111) and the second economizer circuit (112) based on information indicating the operating state of the screw compressor (1).

As can be seen, the supply operations of the first economizer circuit (111) and the second economizer circuit (112) are controlled based on the information indicating the operating state of the screw compressor (1). It is therefore possible to adjust the amount of the fluid supplied to the compression chamber (23) in accordance with the required capacity.

According to a feature of this embodiment, the economizer circuit (110) includes the branch passages (115) and the switching sections (117). The branch passages (115) cause the fluid to diverge from the refrigerant circuit (101).

The switching sections (117) permit or block the circulation of the fluid through the branch passages (115).

Thus, the switching sections (117) can permit or block the circulation of the fluid which has diverged from the refrigerant circuit (101) into the respective branch passages (115). In this embodiment, a configuration in which an electronic expansion valve is used as the switching section (117) has been described. However, a combination of a check valve and an on-off valve, for example, may be used.

Variation of Fifth Embodiment

In the fifth embodiment, a configuration in which first economizer circuit (111), the second economizer circuit (112), and the third economizer circuit (113) are provided has been described. However, the configuration may be without the second economizer circuit (112).

Figure 27:
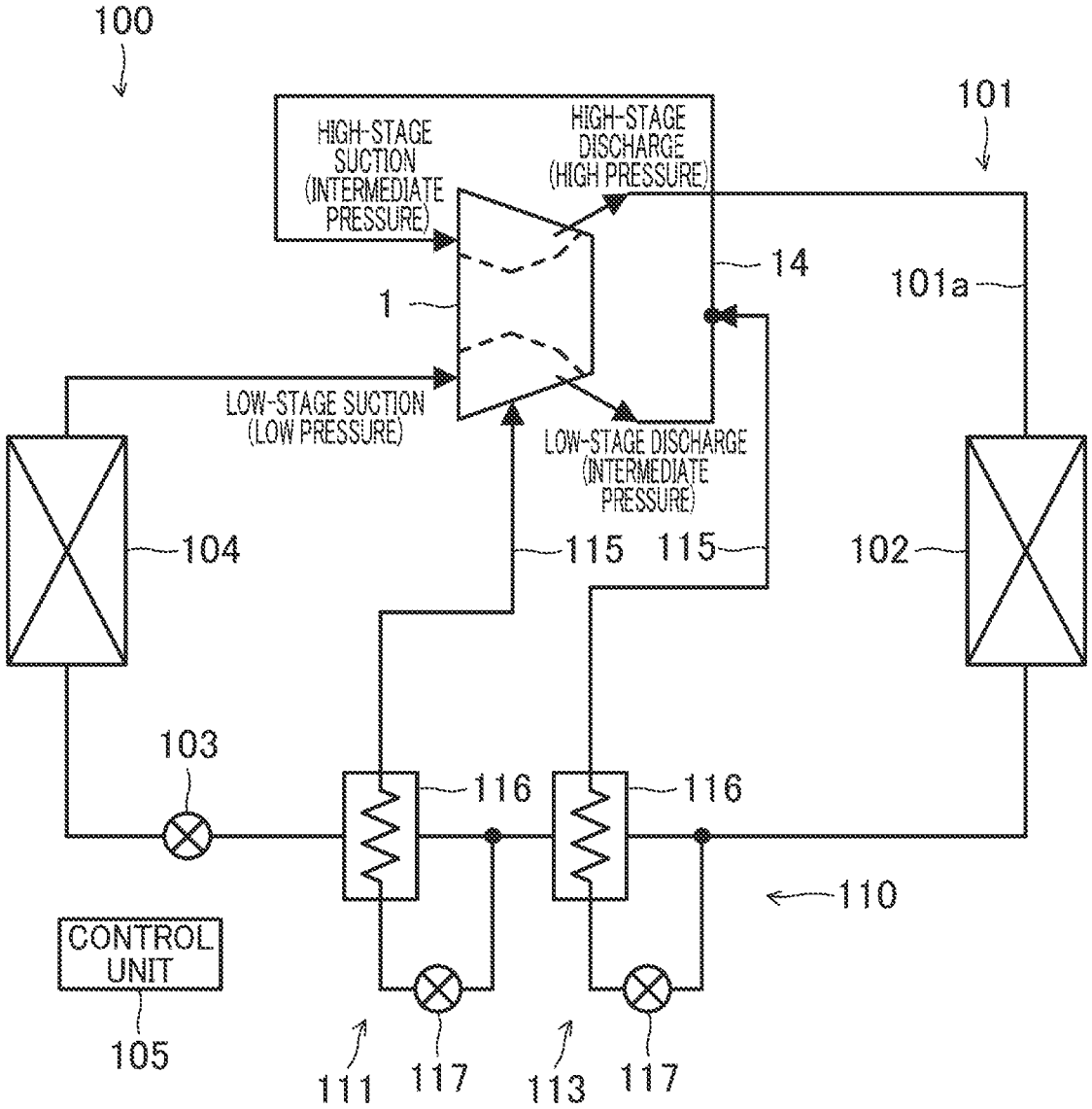
FIG. 27 is a refrigerant circuit diagram showing a flow of a refrigerant through a refrigeration apparatus according to a variation of the fifth embodiment.

As shown in FIG. 27, the economizer circuit (110) includes a first economizer circuit (111) and a third economizer circuit (113).

The first economizer circuit (111) includes a branch passage (115), a heat exchange section (116), and a switching section (117). The upstream end of the branch passage (115) is connected to the refrigerant pipe (101*a*) through which a liquid refrigerant flows. The downstream end of the branch passage (115) is connected to the first compression chamber (24) of the screw compressor (1).

The third economizer circuit (113) includes a branch passage (115), a heat exchange section (116), and a switching section (117). The upstream end of the branch passage (115) is connected to the refrigerant pipe (101*a*) through which the liquid refrigerant flows. The downstream end of the branch passage (115) is connected to the communication passage (14) connecting the discharge side of the first compression chamber (24) and the suction side of the second compression chamber (25) of the screw compressor (1).

The control unit (105) controls a supply operation of the first economizer circuit (111) based on information indicating the operating state of the screw compressor (1).

Other Embodiments

The above-described embodiments may be modified as follows.

In the above embodiments, the first end portion (42) and the second end portion (43), which are the axial end portions of the screw rotor (40), are each formed into a shape having a cylindrical outer peripheral surface, and are respectively provided with the first sealing portion and the second sealing portion. However, as long as the first end portion (42) and the second end portion (43) have a shape that can ensure the sealing performance with respect to the surrounding spaces, the first end portion (42) and the second end portion (43) do not need to be formed into a shape having a cylindrical outer peripheral surface.

In the above embodiments, the first slit (16*a*) and the second slit (16*b*) of the cylindrical wall (16) are used as the inlets of the first compression chamber (24) and the second compression chamber (25). However, these inlets may be formed at any other locations as long as the inlets serve as passages that can introduce the refrigerant (working fluid) into the first compression chamber (24) and the second compression chamber (25).

The configuration and shape of the gate rotor (50) and the ratio between the number of grooves of the screw rotor (40) and the number of teeth of the gate rotor (50) described in the above embodiments are not limited thereto, and may be changed.

The configurations of the first regulation mechanism (81) and the second regulation mechanism (82) of the above embodiments may be appropriately changed as long as it is possible to regulate the suction volume and the compression ratio (internal volume ratio) of the first compression chamber (24) and/or the second compression chamber (25). The configurations described in the above embodiments and variations may be combined as appropriate.

While the embodiments and variations thereof have been described above, it will be understood that various changes in form and details may be made without departing from the spirit and scope of the claims. The foregoing embodiments and variations thereof may be combined and replaced with each other without deteriorating the intended functions of the present disclosure.

As can be seen from the foregoing description, the present disclosure is useful for a screw compressor.

The invention claimed is:

1. A screw compressor, comprising:

a screw rotor having a plurality of screw grooves;

a plurality of gate rotors each including gates that mesh with the screw rotor; and a casing with the screw rotor rotatably inserted therein, the casing having a cylindrical wall through which the gates pass, the screw compressor being configured to have a plurality of compression chambers inside the cylindrical wall, the plurality of compression chambers being defined by the screw rotor and the gates, and the compression chambers including a first compression chamber in which a fluid introduced into the casing at a suction pressure is compressed to an intermediate pressure higher than the suction pressure, and a second compression chamber in which the fluid at the intermediate pressure is compressed to a discharge pressure higher than the intermediate pressure.

2. The screw compressor of claim 1, wherein the casing has a first space communicating with the first compression chamber and a second space communicating with the second compression chamber, around the cylindrical wall, and the first space, the first compression chamber, the second compression chamber, and the second space are connected together in an ascending order of the pressures of the fluid.

3. The screw compressor of claim 2, wherein each of both axial end portions of the screw rotor includes a sealing portion between the cylindrical wall and the screw rotor, the sealing portion being configured to reduce circulation of the fluid.

4. The screw compressor of claim 3, wherein the cylindrical wall has slits through which the gates pass, and the slits include a first slit through which the first space and the first compression chamber communicate with each other, and a second slit through which the second compression chamber and the second space communicate with each other.

5. The screw compressor of claim 1, wherein a ratio N1/N2 of a groove number N1 to a teeth number N2 is greater than or equal to 3/5, where N1 represents the number of the screw grooves, and N2 represents the number of teeth forming the gates of at least one of the gate rotors.

6. The screw compressor of claim 1, wherein a width of each teeth forming the gates decreases from inside to outside in a radial direction of the respective gate rotors.

7. The screw compressor of claim 1, wherein the casing has a motor chamber in which a motor to drive the screw rotor is housed, an introduction passage through which the fluid at the intermediate pressure is introduced into the motor chamber, and a communication passage through which the motor chamber and the second compression chamber communicate with each other.

8. The screw compressor of claim 1, wherein a suction volume of the second compression chamber is smaller than a suction volume of the first compression chamber.

9. The screw compressor of claim 8, wherein a second central angle formed by two of the gates forming the second compression chamber and a center of rotation of the screw rotor is smaller than a first central angle formed by two of the gates forming the first compression chamber and the center of rotation.

10. The screw compressor of claim 1, further comprising:

a first regulation mechanism configured to regulate at least one of a suction volume of the first compression chamber and a suction volume of the second compression chamber.

11. The screw compressor of claim 10, further comprising:

a second regulation mechanism configured to regulate at least one of a compression ratio of the first compression chamber and a compression ratio of the second compression chamber.

12. The screw compressor of claim 11, wherein the first regulation mechanism includes a first slide valve configured to shift in an axial direction of the screw rotor to regulate an opening area of a first opening formed in the cylindrical wall, the second regulation mechanism includes a second slide valve configured to shift in the axial direction of the screw rotor to regulate an opening area of a second opening formed in the cylindrical wall, and the screw compressor further includes a driving mechanism configured to drive the first slide valve and the second slide valve.

13. The screw compressor of claim 11, wherein the first regulation mechanism includes a first slide valve configured to shift in an axial direction of the screw rotor to regulate an opening area of a first opening formed in the cylindrical wall, the second regulation mechanism includes a second slide valve configured to shift in the axial direction of the screw rotor to regulate an opening area of a second opening formed in the cylindrical wall, and the opening area of the second opening regulated by the second slide valve is smaller than the opening area of the first opening regulated by the first slide valve.

14. The screw compressor of claim 1, further comprising:

a motor configured to drive the screw rotor at a variable speed; and a first regulation mechanism configured to regulate at least one of a suction volume of the first compression chamber and a suction volume of the second compression chamber.

15. The screw compressor of claim 1, further comprising:

a motor configured to drive the screw rotor at a variable speed; and a second regulation mechanism configured to regulate at least one of a compression ratio of the first compression chamber and a compression ratio of the second compression chamber.

16. The screw compressor of claim 1, wherein the casing includes an oil reservoir in which oil is stored, a suction chamber that communicates with a suction opening of one of the first compression chamber or the second compression chamber included in the compression chambers is provided outside of an axial end of the screw rotor in the casing, a sealing portion configured to reduce circulation of the fluid between an other one of the first compression chamber or the second compression chamber included in the compression chambers and the suction chamber is provided between the cylindrical wall and the screw rotor, and at least a portion of the sealing portion is immersed in the oil in the oil reservoir.

17. The screw compressor of claim 16, wherein the sealing portion of the cylindrical wall includes a sealing start portion where a sealing surface of the screw rotor that is rotating starts overlapping with the sealing portion, and the scaling start portion of the cylindrical wall is immersed in the oil in the oil reservoir.

18. The screw compressor of claim 16, wherein an inner peripheral surface of the cylindrical wall has a first groove extending axially from a position overlapping the sealing portion, and an axial end portion of the first groove is open to the suction chamber or a space having a higher pressure in one of the compression chambers sealed by the sealing portion.

19. The screw compressor of claim 18, wherein the inner peripheral surface of the cylindrical wall has a second groove extending circumferentially at a position overlapping the sealing portion and communicating with the first groove.

20. The screw compressor of claim 1, wherein a suction chamber that communicates with a suction opening of one of the first compression chamber or the second compression chamber included in the compression chambers is provided outside of an axial end of the screw rotor in the casing, a sealing portion configured to reduce circulation of the fluid between an other one of the first compression chamber or the second compression chamber included in the compression chambers and the suction chamber is provided between the cylindrical wall and the screw rotor, an end portion of the cylindrical wall adjacent the suction chamber has a cut-out formed by cutting out a portion of the cylindrical wall, and the suction chamber and one of the compression chambers which communicates with the suction chamber communicate with each other through the cut-out.

21. The screw compressor of claim 1, wherein a suction chamber that communicates with a suction opening of one of the first compression chamber or the second compression chamber included in the compression chambers is provided outside of an axial end of the screw rotor in the casing, a sealing portion configured to reduce circulation of the fluid between an other one of the first compression chamber or the second compression chamber included in the compression chambers and the suction chamber is provided between the cylindrical wall and the screw rotor, an end portion of the cylindrical wall adjacent the suction chamber has a recessed portion formed by recessing a portion of an inner peripheral surface of the cylindrical wall, and the suction chamber and one of the compression chambers which communicates with the suction chamber communicate with each other through the recessed portion.

22. A refrigeration apparatus including the screw compressor of claim 1, the refrigeration apparatus further comprising:

a refrigerant circuit with the screw compressor connected thereto, the refrigerant circuit being configured to circulate the fluid to perform a refrigeration cycle; and an economizer circuit configured to cause the fluid to diverge from an intermediate point of the refrigerant circuit, the economizer circuit being configured to supply the fluid into at least one of the compression chambers in course of compression, the economizer circuit being connected to at least one of the first compression chamber and the second compression chamber.

23. The refrigeration apparatus of claim 22, wherein the economizer circuit includes a first economizer circuit connected to the first compression chamber, and a second economizer circuit connected to the second compression chamber, and the refrigeration apparatus further includes a control unit configured to control supply operations of the first economizer circuit and the second economizer circuit based on information indicating an operating state of the screw compressor.

24. The refrigeration apparatus of claim 22, wherein the economizer circuit includes a branch passage causing the fluid to diverge from the refrigerant circuit, and a switching section configured to permit or block circulation of the fluid through the branch passage.

* * * * *